US007364251B2

(12) United States Patent
Arakawa et al.

(10) Patent No.: US 7,364,251 B2
(45) Date of Patent: Apr. 29, 2008

(54) INKJET RECORDING APPARATUS AND RECORDING MEDIUM MOVEMENT CONTROL METHOD

(75) Inventors: Hiroaki Arakawa, Uenohara-machi (JP); Yoshikazu Maekawa, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 270 days.

(21) Appl. No.: 10/910,527

(22) Filed: Aug. 3, 2004

(65) Prior Publication Data

US 2005/0035989 A1 Feb. 17, 2005

(30) Foreign Application Priority Data

Aug. 13, 2003 (JP) ..... 2003-293138
Aug. 13, 2003 (JP) ..... 2003-293139
Sep. 10, 2003 (JP) ..... 2003-318914
Feb. 17, 2004 (JP) ..... 2004-039660

(51) Int. Cl.
*B41J 29/38* (2006.01)
*B41J 2/01* (2006.01)
*B65H 7/02* (2006.01)

(52) U.S. Cl. ..... 347/16; 347/104; 271/265.01

(58) Field of Classification Search ..... 347/16
See application file for complete search history.

(56) References Cited

U.S. PATENT DOCUMENTS 4,734,868 A 3/1988 DeLacy
4,839,674 A 6/1989 Hanagata et al.
5,539,434 A 7/1996 Fuse
5,627,571 A 5/1997 Anderson et al.
5,777,638 A 7/1998 Salter et al.
6,068,362 A * 5/2000 Dunand et al. ..... 347/16
6,158,344 A 12/2000 Walker et al.
6,241,334 B1 6/2001 Haselby
6,302,510 B1 10/2001 Yoshida
6,315,382 B1 * 11/2001 Gudaitis et al. ..... 347/19
6,352,331 B1 3/2002 Armijo et al.
6,364,549 B1 * 4/2002 Lesniak et al. ..... 400/74

(Continued)

FOREIGN PATENT DOCUMENTS

JP 59-171664 A 9/1984

(Continued)

*Primary Examiner*—Matthew Luu
*Assistant Examiner*—Shelby Fidler
(74) *Attorney, Agent, or Firm*—Frishauf, Holtz, Goodman, Chick, P.C.

(57) ABSTRACT

An inkjet recording apparatus including: a recording head; a recording medium moving section; a position information detecting section synchronized with a movement of the recording medium moving section; a mark recording section for recording a mark on the recording medium; a mark detecting section for detecting the mark recorded; an analog-to-digital conversion section for converting an output signal; and a control section for obtaining a reference mark position of the mark based on a signal outputted from the mark detecting section and the position information detected, and for determining the amount of recording medium movement on the basis of reference detection position of the mark; wherein analog-to-digital conversion is applied to the output signal from the mark detecting section to get a sampling data, in exact timing with an output of position information, and the control section calculates the reference detection position from the sampling data.

6 Claims, 29 Drawing Sheets

U.S. PATENT DOCUMENTS

| | | | | |
|---|---|---|---|---|
| 6,386,671 | B1 | 5/2002 | Huston et al. | |
| 6,412,909 | B1 | 7/2002 | Tayuki et al. | |
| 6,425,650 | B1 | 7/2002 | Walker et al. | |
| 6,547,355 | B1 | 4/2003 | Shimada et al. | |
| 6,655,774 | B2 * | 12/2003 | Maruyama | 347/16 |
| 6,663,206 | B2 | 12/2003 | Taylor | |
| 6,769,759 | B2 * | 8/2004 | Yamasaki et al. | 347/41 |
| 6,775,022 | B2 | 8/2004 | Noyes et al. | |
| 6,900,449 | B2 | 5/2005 | Bolash et al. | |
| 2002/0012027 | A1 | 1/2002 | Moon et al. | |
| 2004/0075708 | A1 | 4/2004 | Arakawa | |

FOREIGN PATENT DOCUMENTS

| | | | |
|---|---|---|---|
| JP | 03-042264 | A | 2/1991 |
| JP | 04-019149 | A | 1/1992 |
| JP | 11-334160 | A | 12/1999 |
| JP | 2000-218891 | A | 8/2000 |
| JP | 2004-188954 | A | 7/2004 |

* cited by examiner

FIG. 22 ( a )
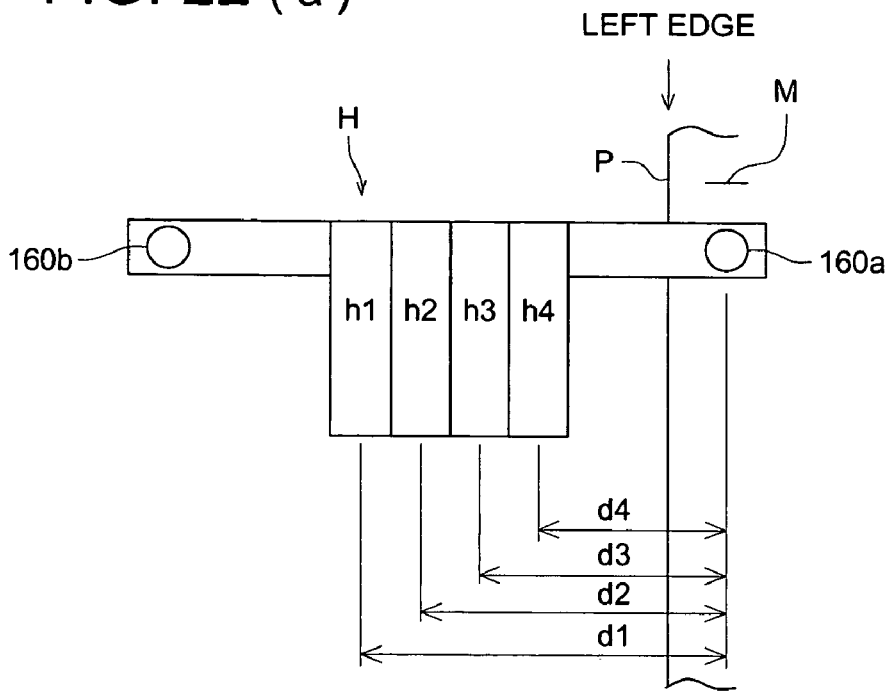
FIG. 22 ( b )
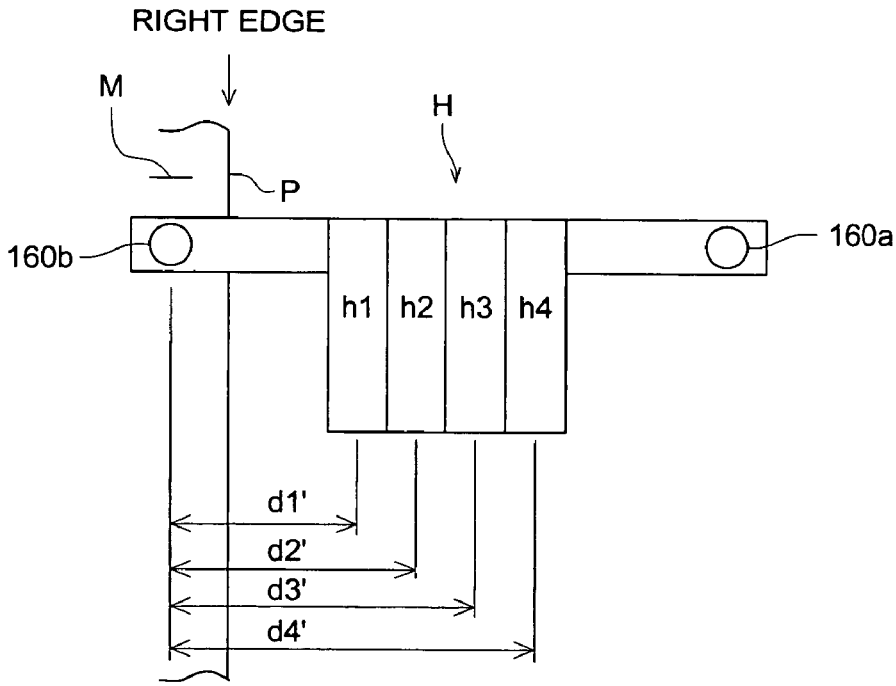

FIG. 28 ( a )
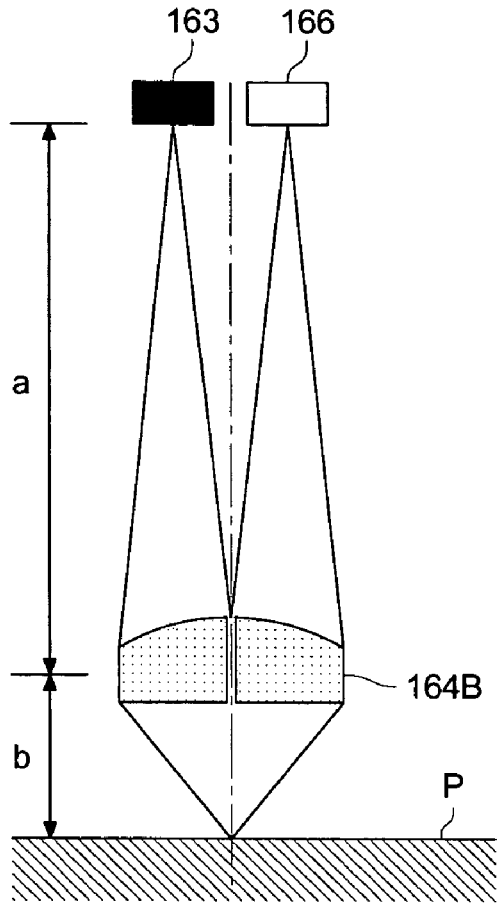
FIG. 28 ( b )
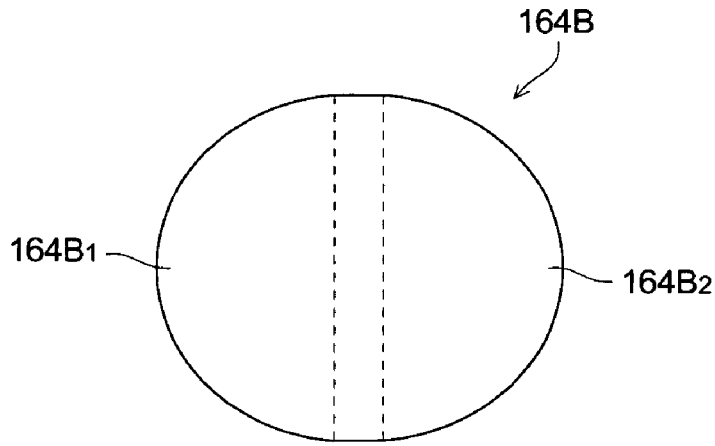

INKJET RECORDING APPARATUS AND RECORDING MEDIUM MOVEMENT CONTROL METHOD

BACKGROUND OF THE INVENTION

The present invention relates to an inkjet recording apparatus, in particular, to an inkjet recording apparatus characterized by enhanced feed precision in moving a recording medium in the direction of feed.

In an inkjet recording apparatus for recording a desired image by discharging ink particles on a recording medium, the recording head for discharging ink particles is moved on the recording medium in the main scanning direction, and the recording medium is moved in the sub-scanning direction orthogonal to the main scanning direction every time one line has been recorded. This procedure is repeated.

In the prior art, movement of a recording medium in the sub-scanning direction is carried out in an intermittent feed by a stepping motor, or by a DC motor equipped with a rotary encoder. In the former case, a predetermined number of pulses is added to the stepping motor, every time the recording head has recorded one line in the main scanning direction, and the recording medium is moved a predetermined distance in the sub-scanning direction, using the number of the steps at that time as a feed distance (Patent Document 1). In the latter case, the amount of movement of the recording medium fed in the sub-scanning direction is scanned as the pulses of the rotary encoder, and the pulses capable of obtaining a predetermined amount of feed is counted, whereby control is performed (Patent Document 2).

According to a further prior art, a rotary encoder is mounted on the rotary shaft of the feed roller for moving the recording medium in the sub-scanning direction, and the pulses are counted, whereby the amount of feed is controlled (Patent Document 3).

In recent years, there has been an increase in the number of recording head nozzles due to high speed recording of a high quality image. With the growing length along the nozzle train of the recording head, the amount of feed of the recording medium in the sub-scanning direction is increased, and this requires improvement of feed precision. For example, in the prior art method of filling the image by n-passes of the nozzle interval, efforts have been made to find out a method for getting a high-quality image free of banding by so-called block printing, where movement of a very short distance is performed in n−1 passes and movement of a long distance is carried out in the remaining one pass. Such a recording method requires the recording medium to be moved a long distance at a time in the sub-scanning direction. This, in turn, requires a drastic improvement of feed precision. Accordingly, such a printing method is not used in practice.

This is because of the following reasons: As described above, in the inkjet recording apparatus, the amount of recording medium feed is detected only indirectly by counting the pulses of the stepping motor for driving the recording medium feed roller, and the number of pulses of the rotary encoder. This method produces an error with reference to the actual amount of the recording medium feed. This error causes a white streak to be produced especially between the blocks, whereby image quality is deteriorated. In other words, the amount of recording medium feed detected by counting the pulses fails to represent the true amount of the recording medium feed, due to many factors such as a feed roller diameter, feed roller shaft center position, the difference in the thickness of the recording medium and slip between the feed roller and recording medium, regardless of whether a stepping motor or a DC servo motor using a rotary encoder is used. This produces an error with reference to actual amount of the recording medium, thereby causing a white streak to be produced. Such a trouble tends to be improved when a rotary encoder is mounted on the rotary shaft of the feed roller, but no sufficient improvement effect has been obtained so far in the face of the increasing feed amount.

To solve this problem, a proposal has been made of a technique wherein a predetermined mark is recorded on the recording medium and the amount of recording head movement is determined with reference to the position where this mark is detected, thereby improving the recording medium feed precision. (Patent Documents 4 and 5)

[Patent Document 1] Official Gazette of Japanese Patent Tokkaihei 11-334160

[Patent Document 2] Official Gazette of Japanese Patent Tokkaisho 59-171664

[Patent Document 3] Official Gazette of Japanese Patent Tokkaihei 4-19149

[Patent Document 4] Official Gazette of Japanese Patent Tokkaihei 3-42264

[Patent Document 5] Official Gazette of Japanese Patent Tokkai 2000-218891

The present inventors have proposed an inkjet recording apparatus wherein ink particles are discharged from at least one nozzle in the process of moving the recording head in the main scanning direction, and a predetermined mark is recorded on the recording medium and is detected by a mark detecting means that moves the mark together with the recording head, in such a manner that the amount of recording head movement is determined with reference to the position where the mark detecting means has detected a detection signal, with the result that high precision movement is ensured even when the recording medium is moved a long distance (Tokugan 2002-304279).

In such an inkjet recording apparatus, a mark detecting means for detecting a mark recorded on the recording medium is arranged in the vicinity of the recording head, and is fed in the main scanning direction together with the recording head. It performs reciprocating motion by reversing its direction on the side of the recording medium along the width. Reversing its direction on the side of the recording medium along the width is essential to move the recording head at a constant speed on the printing area of the recording medium. This requires a certain accelerated feed distance until the constant speed is reached from the rest position at 0 speed.

In the meantime, the mark recorded by the recording head for recording an image is basically recorded in the vicinity of the lateral end of the recording medium deviated from the printing area of the recording medium. Thus, to detect the mark, the movement of the recording head must be stopped temporarily at the position of the mark recorded on the recording medium.

However, the mark detecting means is located above the recording medium, and the recording head rest position for detecting the mark by means of the mark detecting means is not located at the position where the cartridge with the recording head mounted thereon is reversed to perform reciprocating motion. Therefore, the cartridge restarts movement from the position where the mark detecting means has detected the mark, until it reaches the reversing position. Then the reversing operation must be started at that position. Thus, the cartridge is required to repeat start/stop operations for mark detection, in addition to reversing operations for reciprocating motion. This is a waste of movement, and hence reduction in printing productivity.

SUMMARY OF THE INVENTION

To detect the mark recorded by the recording medium, the mark is sensed, and its detection output is compared with a predetermined voltage. A reflection type photosensor is commonly used as such a sensor, so its detection output depends on the distance from the recording medium. However, the height of the recording medium surface is not constant at all times, due to the influence of cockling or changes in the suction to the platen. In terms of circuits, there are many factors causing output fluctuations under the influence of external disturbing light, flashing of devices and temperature characteristics. Especially when a linear mark consisting of a thin line is used as the mark, the photoreceiving signal will be subjected to a substantial amplification when it has been detected. A slight influence will give a big influence to the reference level.

However, when the output value is compared at a constant potential as in the prior art, a big error may occur if the reference potential is different, or the unmarked position may be detected. Thus, insufficient reliability has been a problem of the prior art.

In view of the prior art described above, it is an object of the present invention to improve the reliability of mark detection in an inkjet recording apparatus where high precision movement of a recording medium is provided by detecting a mark recorded on a recording medium.

The aforementioned object can be achieved by the present invention characterized by the following features:

(1) An inkjet recording apparatus comprising:

a recording medium moving section for moving a recording medium in the direction of its feed;

a position information detecting section for detecting the position information of the aforementioned recording medium moving section, synchronized with the aforementioned recording medium moving section;

a mark recording section for recording a predetermined mark on the recording medium;

a mark detecting section, arranged at a predetermined distance from the recording medium, for detecting the mark recorded by the mark recording section; and a control section for obtaining the position of the mark, based on the output signal issued when the mark has been detected by the mark detecting section and the position information from the position information detecting section and for determining the amount of recording medium movement by the recording medium moving section, with reference to the mark position;

wherein the aforementioned inkjet recording apparatus further has an analog-to-digital converting section for analog-to-digital conversion of the output signal from the mark detecting section; the control section for applying analog-to-digital conversion to the output signal from the mark detecting section, in exact timing with the output of position information by the position information detecting section; and the reference detection position of the mark is calculated from the sampling data.

(2) An inkjet recording apparatus comprising:

a recording medium moving section for moving a recording medium in the direction of its feed;

a position information detecting section for detecting the position information of the aforementioned recording medium, synchronized with the aforementioned recording medium moving section;

a mark recording section for recording a predetermined mark on the recording medium;

a mark detecting section, arranged at a predetermined distance from the recording medium, for detecting the mark recorded by the mark recording section; and a control section for obtaining the position of the mark, based on the output signal issued when the mark has been detected by the mark detecting section and the position information from the position information detecting section and for determining the amount of recording medium movement by the recording medium moving section, with reference to the mark position;

wherein the aforementioned inkjet recording apparatus further comprises a clamping section for clamping the output signal of the mark detecting section at the position immediately before the position where the mark is predicted to be detected by the position information detecting section, and the portion where the aforementioned mark and image are not recorded on the recording medium.

(3) An inkjet recording apparatus comprising:

a recording head for discharging ink particles toward the recording medium from a plurality of nozzles;

a recording head moving section for moving a recording head in the main scanning direction;

a recording medium moving section for moving said recording medium in the sub-scanning direction;

a mark recording section for recording a predetermined mark on the recording medium by discharging ink particles from at least any one of the nozzles in the process of the recording head being moved by the recording head moving section; and a mark detecting section, arranged at a predetermined distance from the recording medium, and moved by the recording head moving section together with the recording head, for detecting the mark recorded by the mark recording section; and wherein the amount of recording medium movement by the recording medium moving section is determined with reference to the position where the mark recording section has detected the detection signal; the mark recording section is arranged at a distance equal to or longer than the accelerated movement distance of the recording head by the recording head moving section, in terms of the interval with respect to the recording head in the main scanning direction.

(4) An inkjet recording apparatus comprising:

a recording head for discharging ink particles toward the recording medium from a plurality of nozzles;

a recording head moving section for moving a recording head in the main scanning direction;

a recording medium moving section for moving said recording medium in the sub-scanning direction;

a position information detecting section for detecting the position information of the recording medium moving section synchronized with the drive of the recording medium moving section;

a mark recording section for recording a predetermined mark on the recording medium in a predetermined timing;

a mark detecting section, arranged at a predetermined distance from the recording medium, for detecting the mark recorded by the mark recording section;

a target moving distance calculation section for calculating the target moving distance of the recording medium, with reference to the position detected by the position information detecting section when the mark detecting section has detected the detection signal;

an estimated moving distance storage section for storing the estimated moving distance predicted in advance as the target moving distance of the recording medium;

a comparing section for making comparison between the target moving distance calculated by the target moving distance calculation section when the mark detecting section has detected the detection signal, and the estimated moving distance stored in the estimated moving distance storage section;

a switching section for switching the moving distance of the recording medium by the recording medium moving section to either the target moving distance calculated by the target moving distance calculation section or to the estimated moving distance stored in the estimated moving distance storage section, based on the result of comparison by the comparing section.

(5) A recording medium movement control method comprising the steps of:

moving the recording medium in the sub-scanning direction with respect to the recording head, moved in the main scanning direction, for discharging ink particles to the recording medium from a plurality of nozzles;

recording a predetermined mark on the recording medium by means of a mark detecting section in a predetermined timing detecting the mark by means of the mark detecting section arranged at a certain distance from the recording medium; and controlling the movement of the recording medium with reference to the position where the mark has been detected by the mark detecting section;

wherein the aforementioned recording medium movement control method further comprises the steps of:

calculating the target moving distance of the recording medium, with reference to the position of the detected mark, when the mark has been detected by the mark detecting section;

comparing the calculated target moving distance and estimated moving distance stored in advance as the target moving distance of the recording medium, when the mark has been detected; and switching the moving distance of the recording medium to either the calculated target moving distance or the estimated moving distance, based on the result of comparison.

The present invention provides an inkjet recording apparatus characterized by a high-precision movement of the recording medium and enhanced reliability in mark detection.

BRIEF DESCRIPTION OF THE DRAWINGS

FIGS. 22(*a*) and (*b*) are schematic plan views of the optical sensor installed on each of both ends of the recording head main scanning direction;

FIG. 28(*a*) is a drawing showing a further configuration of the optical sensor; FIG. 28(*b*) is a plan showing the condensing lens thereof;

DETAILED DESCRIPTION OF THE PREFERRED EMBODIMENT

The following describes the preferred embodiments of the present invention.

Embodiment-1

Figure 1:
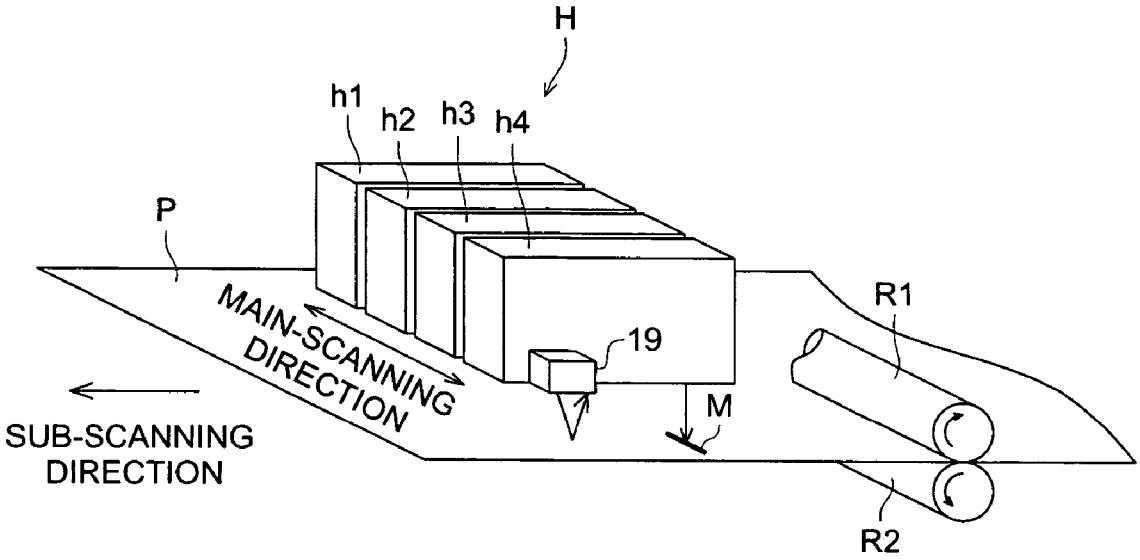
FIG. 1 is a configuration diagram representing the overview of an inkjet recording apparatus of the present invention.
Figure 2:
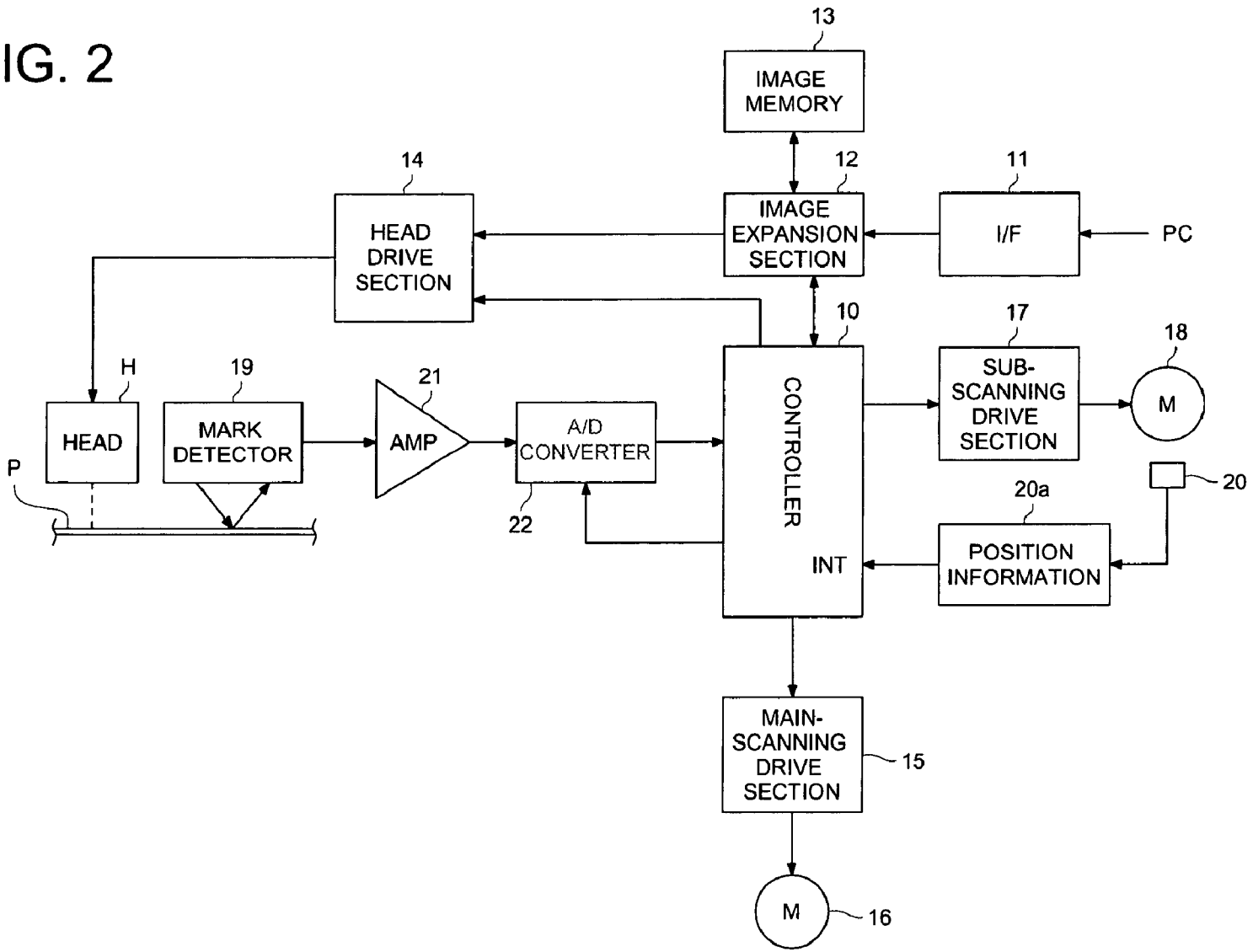
FIG. 2 is a block diagram representing the configuration of an inkjet recording apparatus of the present invention.

FIG. 1 is a configuration diagram representing the overview of an inkjet recording apparatus of the present invention, and FIG. 2 is a block diagram representing the same. In the diagram, H denotes a recording head. The figures show four heads h1 through h4 corresponding to four colors—Y, M, C and K, respectively, as example. The number of heads constituting the recording head H is not restricted in particular.

On the bottoms of heads h1 through h4, many nozzles (not illustrated) are arranged in a line in the direction orthogonal to the main scanning direction of the recording head H. Ink in the form of minute ink particles is discharged from the nozzles of heads h1 through h4 downward in a predetermined timing, as shown in FIG. 1, whereby a desired image based on image data is recorded on the recording medium P.

The image data is stored once into the image memory 13 through the I/F section 11 and image expansion section 12 from the external PC (personal computer), and the image expansion section 12 is controlled by the controller 10, whereby the image data is read from the image memory 13. Then it is re-expanded in a predetermined order of arrangement in the image expansion section 12, and is then sent to the head drive section 14. The head drive section 14 discharges ink in response to the image data expanded by the image expansion section 12 from each of the heads h1 through h4, thereby allowing the image to be recorded.

The recording head H is mounted on the cartridge (not illustrated). With the heads h1 through h4 formed in an integral structure, the main-scanning motor 16 is driven by the main-scanning drive section 15 driven and controlled by the controller 10, and reciprocating motion is provided in the main scanning direction shown in FIG. 1. In the present invention, the recording head moving section consists of the aforementioned controller 10, main-scanning drive section 15 and main-scanning motor 16.

The recording medium P is sandwiched between the drive roller turned by a sub-scanning motor 18 and a pair of feed rollers R1 and R2 consisting of driven rollers arranged opposite to the drive roller. The sub-scanning motor 18 is driven by a sub-scanning driven section 17 driven by the controller 10, whereby the recording medium P is fed intermittently a predetermined distance at one time in the sub-scanning direction (leftward in FIG. 1) orthogonal to the scanning direction of the recording head H. In the present embodiment, the recording medium moving section of the present invention is composed of the aforementioned controller 10, sub-scanning driven section 17, sub-scanning motor 18 and feed rollers R1 and R2.

In the inkjet recording apparatus of the present invention, the head drive section 14 is driven under the control of the controller 10 in the process of the recording head H being moved in the main scanning direction by the aforementioned recording head moving section, whereby ink particles are discharged from at least any one of the nozzles and a predetermined mark M is recorded on the recording medium P. In the present embodiment, the mark recording section is composed of the controller 10 head drive section 14 and recording head H.

If the mark M recorded on the recording medium P can be recorded by the mark recording section as well as by the mark detecting section to be described later, a mark of any form may be used. The mark used here is the one recorded as a linear mark having a predetermined length (e.g. 1.0 mm) in the main scanning direction. Such a linear mark can be easily recorded in the process of the recording head H being scanning in the main scanning direction. Further, this arrangement permits accurate detection by the mark detecting section to be described later.

Figure 3:
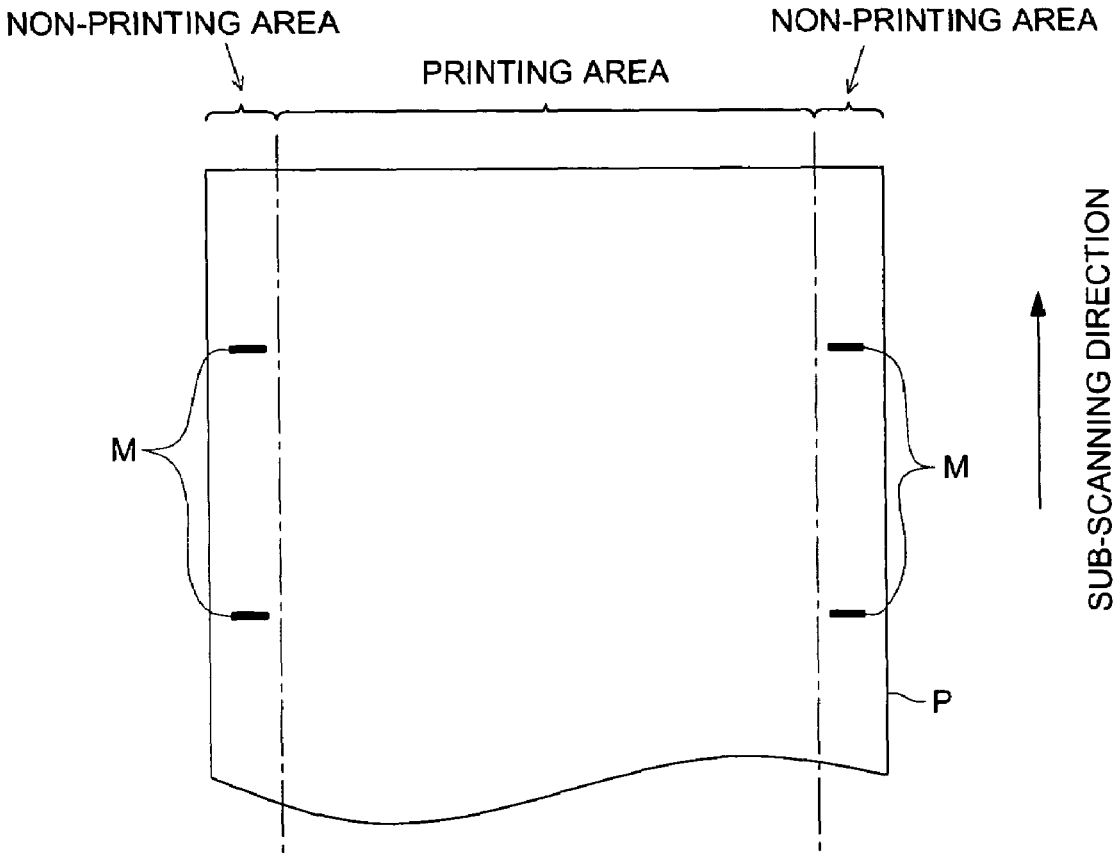
FIG. 3 is a drawing representing a mark recorded position on the recording medium.

In order to ensure that the image is not affected by the area for recording the mark M, if a "bordered image" having a non-printing area (where printing is not performed) is to be recorded on both ends of the recording medium P in the sub-scanning direction, as shown in FIG. 3, it is preferred that the mark M be recorded in a place out of the non-printing area off the printing area of this recording medium P. In this case, the mark M may be recorded each of the non-printing areas on both sides. It is sufficient that the mark M is recorded on either of the two non-printing areas—only on the side where the mark detecting section to be described later is mounted, to put it more specifically.

As described in the present embodiment, when the mark is recorded using the recording head consisting of a plurality of heads h1 through h4, the head for recording the mark, it is sufficient that mark M is recorded on either of the heads (e.g. head h4). Further, when ink particles are discharged from the nozzle, it is also sufficient that at least any one of a plurality of nozzles of one head.

Figure 4:
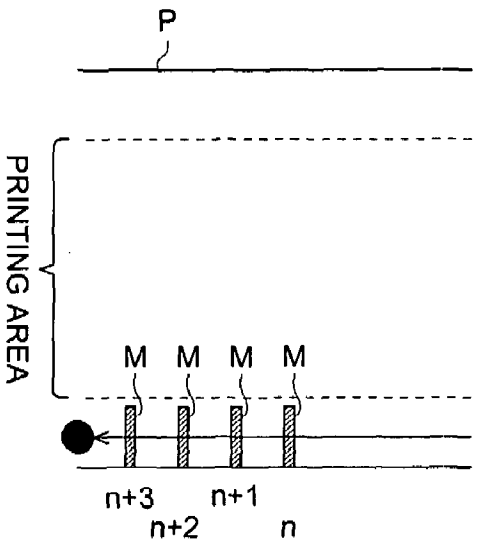
FIGS. 4(*a*) through (*c*) are drawings showing how the mark is recorded when recording a bordered image.
Figure 4:
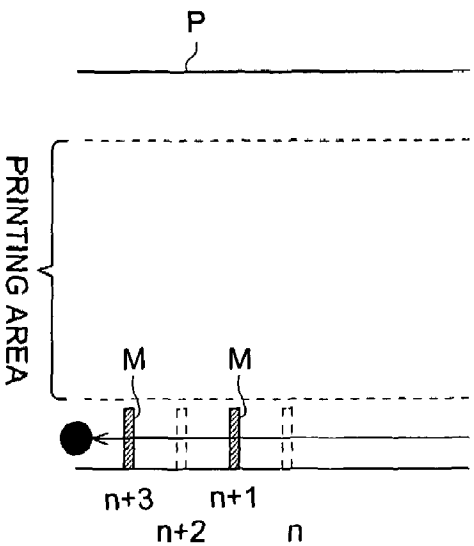
Figure 4:
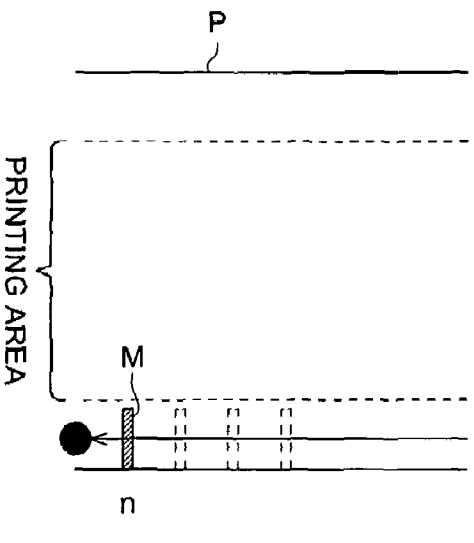

The mark M can be recorded in various ways. For example, the following methods can be mentioned: One mark M is recorded from one nozzle of one head, as shown in FIG. 4(*a*); one mark M is recorded from alternate nozzles of multiple adjacent nozzles on one head (two nozzles in this embodiment) of one head, as shown in FIG. 4(*b*); and multiple marks M are recorded at one time from multiple adjacent nozzles on one head (four nozzles in this embodiment) of one head, as shown in FIG. 4(*c*). The black dots in the drawing indicate the detected light emitted on the recording medium P from the mark detector 19. They also show the mode of recording the mark M when a bordered image is recorded.

The color of the mark M to be recorded can be considered as follows: When an image is recorded by ink of a plurality of colors using a plurality of heads, the mark M will be less conspicuous on the recording medium P if Y (yellow) ink is used, so yellow is recommended. When the multiple heads are capable of discharging ink of different densities, yellow ink of low density, and the mark will be much less conspicuous, so this color is recommended.

Figure 5:
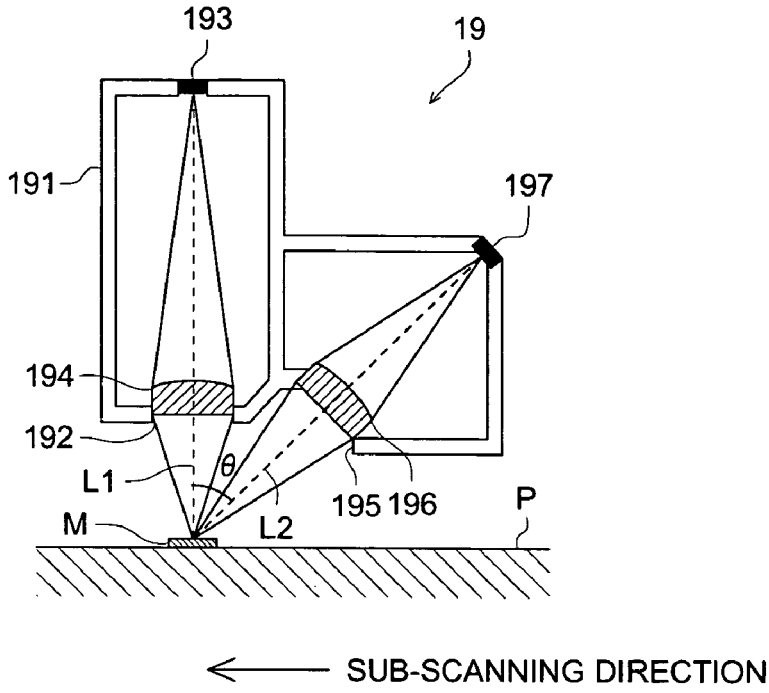
FIGS. 5(*a*) and (*b*) are drawings showing the construction of a mark detecting section.
Figure 5:
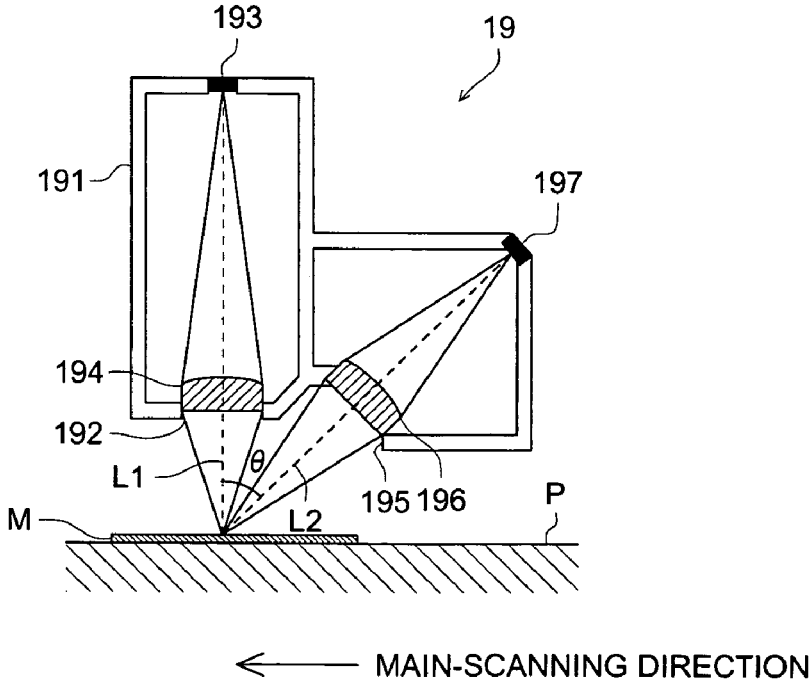

As shown in FIGS. 1 and 2, a mark detector 19 as a mark detecting section of the present invention is mounted on either one end of the recording head H in the main scanning direction. As shown in FIG. 5(*a*), this mark detector 19 consists of a reflection type optical sensor comprising:

a light emitting device for applying detection light approximately in the vertical direction toward the surface of the recording medium P through the opening 192, in the casing 191;

a condensing lens 194;

a condensing lens 196 for condensing and converging the reflection light formed by the aforementioned detection light reflected on the recording medium P through the opening 195; and a light receiving device 197 for receiving the detection light condensed by the condensing lens 196. This mark is detected by detecting changes in the amount of light when the detection light applied to the recording medium P has passed through the mark M on the moving recording medium P. The output signal from the mark detector 19 is inputted into the controller 10 through an AMP (amplifier) 21 and A/D converter 22 to be described later.

When the mark M is recorded by the yellow ink, it is preferred that the blue LED emitting device (having a wavelength of 460 nm through 500 nm) be used as a light emitting device (light emitting device) 193 used in this mark detector 19, in order to ensure satisfactory detection of the mark M. Further, the light receiving device 197 is preferred to be a blue one, i.e. a light receiving device having sensitivity to the light of the wavelength emitted by the aforementioned blue LED. A photosensor is commonly used as the light receiving device 197.

The mark detector 19 is preferred to perform the functions of a sensor as recording medium detecting means for detecting the presence/absence of the recording medium P, i.e. for determining whether or not the recording medium P has been sent to the position where the recording medium P is recorded by the recording head H. Since it can perform the functions of a sensor as recording medium detecting means, the number of parts is reduced to improve cost cutting effects.

As shown in the present embodiment, in the case of the mark detector 19 so arranged as to perform a reciprocating motion in the main scanning direction together with the recording head H, it is also preferred to perform the functions of a sensor as both-directional position detecting means for alignment of the recording head H with respect to the recording medium P in both directions. To put it another way, when the recording head H moves in the main scanning direction, the positions of both sides of the recording medium P is detected by this mark detector 19, whereby alignment of the recording head H in both directions can be carried out. In the similar manner as above, use of the mark detector 19 to perform the functions of a sensor allows the number of parts to be reduced, with the result that cost cutting effects can be improved.

Needless to say, it is more preferred that the mark detector 19 combine the functions of the sensor as recording medium detecting means and the sensor as both-directional position detecting means, because the effect of cutting down the number of parts used is even more improved.

The mark detector 19 shown in FIG. 5(*a*) is arranged in such a manner that the optical axes L1 and L2 of the detection light, emitted from the light emitting device 193 and received by the light receiving device 197, are opposite to each other at an angle θ in the sub-scanning direction. Without being restricted to this configuration, as shown in FIG. 5(*b*), the mark detector 19 may be installed to be oblique with respect to the surface of the recording medium P in the main scanning direction. To put it another way, the light emitting device 193 and light receiving device 197 are arranged so that the optical axes L1 and L2 having an angle θ are opposite to each other in the main scanning direction. Thus, when the optical axes L1 and L2 of the detection light are oblique in the main scanning direction orthogonal to the direction where the recording medium P is transported, and the mark M is formed in a linear shape and is longer in the main scanning direction, then there will be little influence of the line width of the mark M shaped longer in the main scanning direction, in the sub-scanning direction. Thus, detection with very limited errors is provided by the light receiving device 197.

The output signal outputted by detection of the mark M on the recording medium P by the mark detector 19 is amplified to a predetermined signal level by the AMP 21 shown in FIG. 2, and is sent to the A/D converter 22. The A/D converter 22 converts the analog output signal amplified by the AMP 21 to the digital signal, and outputs it to the controller 10.

In the present embodiment, a rotary encoder (not illustrated) as position information detecting means for detecting the position information of the recording medium P is provided. As shown in FIG. 2, an encoder sensor 20 detects the number of the pulses of the rotary encoder outputted synchronously with the movement of a pair of rollers R1 and R2 driven and rotated by the sub-scanning motor 18. The number of pulses detected by the encoder sensor 20 is outputted to the controller 10, as position information 20*a* of the recording medium P corresponding to the moving distance of the rollers R1 and R2. This rotary encoder should be so arranged as to be synchronized with rotation of either the rollers R1 and R2 or sub-scanning motor 18.

Here the controller 10 outputs the instruction to perform A/D conversion, to the A/D converter 22 in exact timing with the output of the position information 20*a* outputted from the aforementioned encoder sensor 20, whereby the aforementioned analog output signal is A/D converted by the A/D converter 22, and the digital output value is inputted as a sampling input value.

Figure 6:
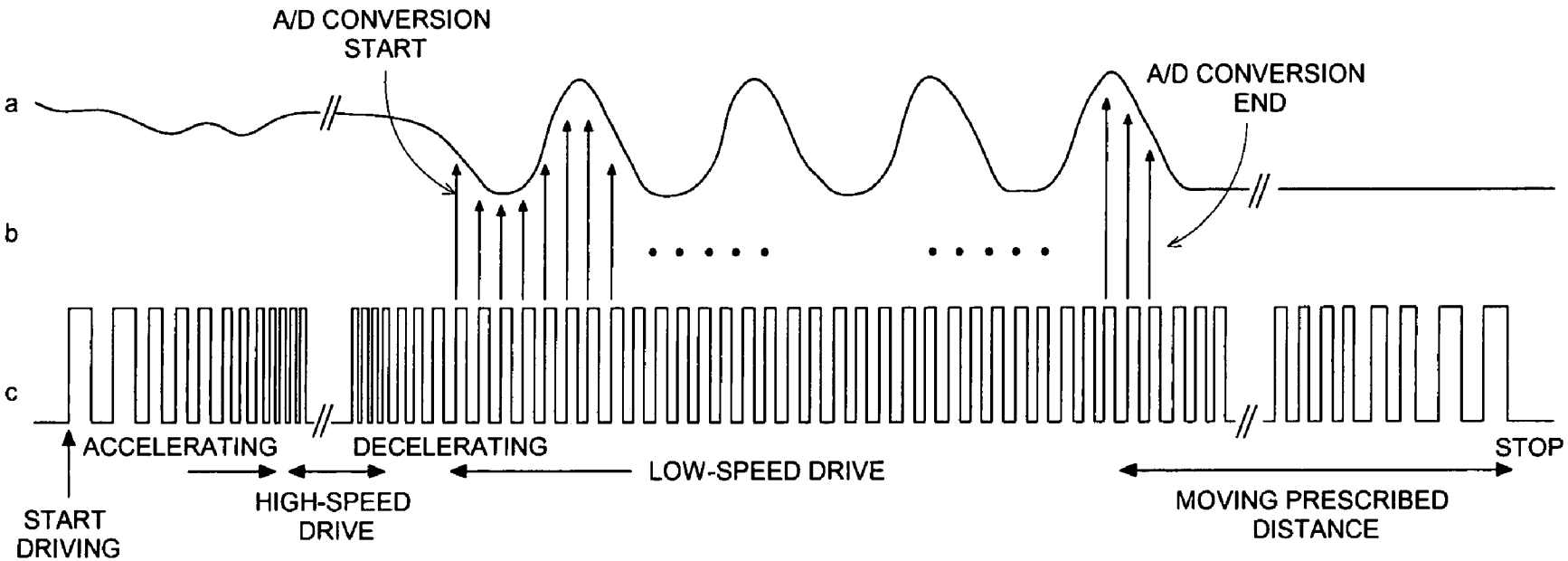
FIG. 6 is a time chart representing the state of sampling.

FIG. 6 is a time chart showing the state of sampling. FIG. 6(*a*) shows the analog output signal from the mark detector 19 outputted to the A/D converter 22 from the AMP 21 in FIG. 2. FIG. 6(*b*) shows the sampling timing outputted to the A/D converter 22 from the controller 10. FIG. 6(*c*) shows the pulse signal of the position information 20*a* outputted to the controller 10 from the encoder sensor 20. FIG. 4(*c*) shows the case of detecting each of the marks M when four marks M are recorded through four nozzles of one head at a time. As shown in FIG. 4(*c*), especially when multiple marks M are recorded at one time through a plurality of nozzles, the mark M detection accuracy can be improved. This arrangement is preferred in the present embodiment.

If the mark M is recorded at predetermined timed intervals through a predetermined nozzle, the approximate position is known in advance; accordingly, when the pulses of the rotary encoder are counted when the recording medium P is moved by the encoder sensor 20, detection can be made to see if the mark M has come close to where mark M is detected by the mark detector 19. Sampling of the output value of the A/D converter 22 by the controller 10 is started immediately before the position where the mark M is predicted to be detected by the mark detector 19; and this is done by the encoder sensor 20 counting the pulses of the rotary encoder.

The position information 20*a* and the sampled output value data (hereinafter also referred to as "sampling data") are stored in a predetermined storage area in the controller 10.

The controller 10 finds out the peak position of the output signal from the mark detector 19, from the sampling data, thereby calculating the reference detection position of the mark M. This sampling data is synchronized with the position information 20*a* from the encoder sensor 20, therefore, it is possible to detect the center position where the detection light of the mark detector 19 has passed through one mark M, i.e. center position of the mark M in the sub-scanning direction, from the position information 20*a* corresponding to the peak position. This calculated position information is stored in a predetermined storage area inside the controller 10.

In the present embodiment, the position of the mark M is detected, based on the output signal and position information 20*a* when the mark M is detected by the mark detector 19. At the same time, the moving distance of the recording medium P by the aforementioned recording medium moving section is determined with reference to the position of the mark M calculated in this way. The position of the mark M by the mark detector 19 is detected according to the peak position of the sampling data. Thus, the detection reliability can be improved, without being affected by the cockling of the recording medium P or the fluctuation in the state of suction onto the platen.

Figure 7:
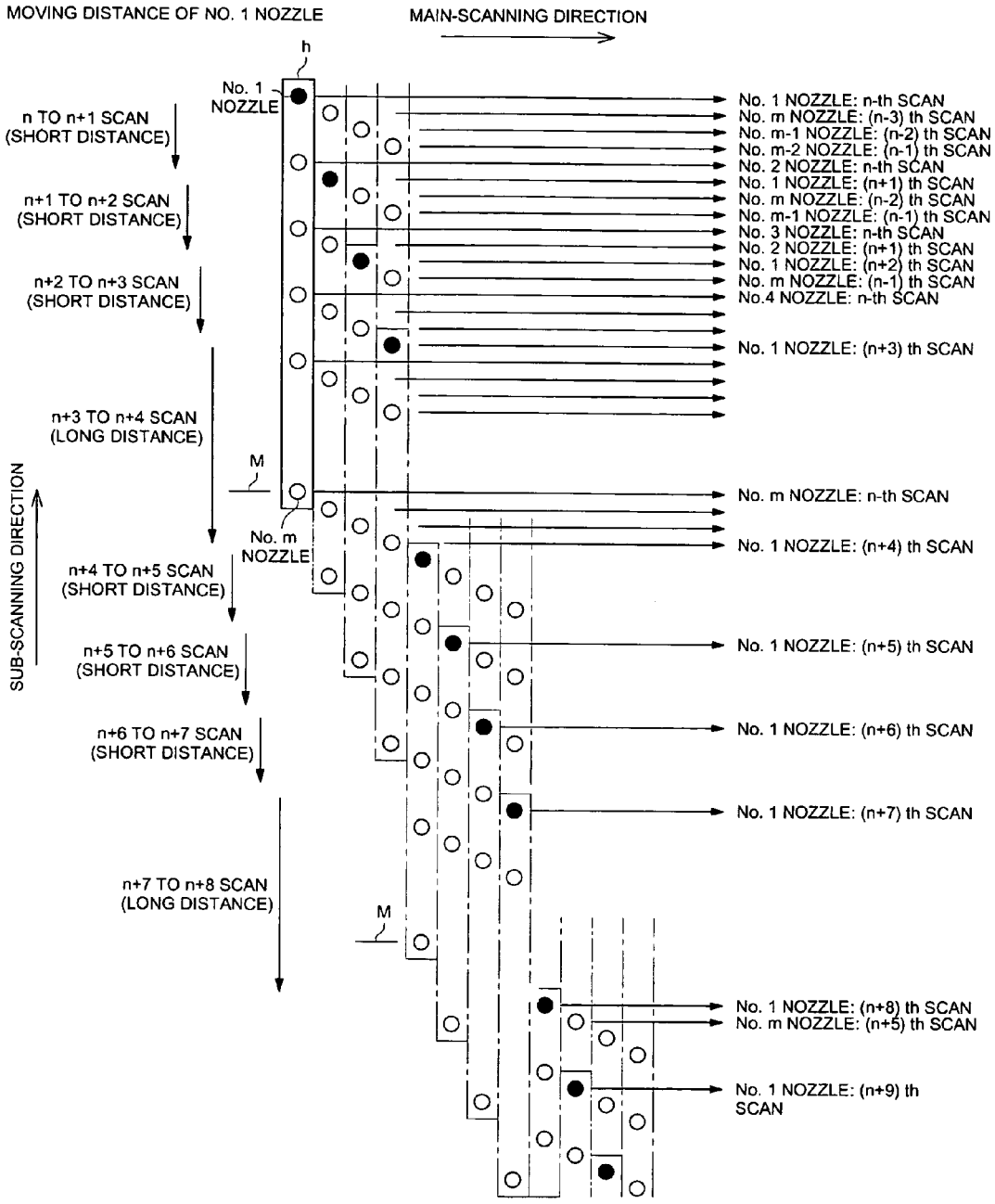
FIG. 7 is an explanatory diagram showing an example of block printing.

Referring to the explanatory diagram showing an example of block printing shown in FIG. 7, the following describes the specific operation of the recording medium P of the present invention: For convenience of explanation, attention is given to only one ("h" in FIG. 7) of the recording head H equipped with a plurality of heads h1 through h4. The recording medium will be described without illustration.

The block printing method shown in FIG. 7 refers to the case where one block is printed by filling the space between nozzles by four passes, using the head h having "m" nozzles from nozzle No. 1 through nozzle No. m. Here the description is based on the assumption that printing is performed by discharging ink particles when the head h is moved (scanned) in the main scanning direction toward the right as illustrated. In the drawing, the nozzle No. 1 in particular is shown by a black dot, and other nozzles are shown by white dots.

In the n-th scanning of the head h (also called "n-scan"), ink particles are discharged from each nozzle to print m lines. After that, the recording medium is moved a predetermined distance by the operation of the recording head moving section so that (n+1)-th scanning is performed by the same head h. For convenience of explanation in FIG. 7, movement of this recording medium is expressed by the movement from the position of n-th scanning of the head h to the position of (n+1)-th scanning toward the lower right in the drawing.

According to this printing method, in (n+1)-th scanning, the recording medium is moved so that the line printed by the nozzle No. 1 of the head h will be adjacent to the line printed by the nozzle No. 2 of the n-th scanning. In (n+2)-th scanning, the recording medium is moved so that the line printed by the nozzle No. 1 of the head h will be adjacent to the line printed by the nozzle No. 2 of the (n+1)-th scanning. In (n+3)-th scanning, the recording medium is moved so that the line printed by the nozzle No. 1 of the head h will be adjacent to the line printed by the nozzle No. 2 of the (n+2)-th scanning. In (n+4)-th scanning, the recording medium is moved so that the line printed by the nozzle No. 1 of the head h will be adjacent to the line printed by the nozzle No. 2 of the (n+3)-th scanning. Here, for example, at the time of movement from n-th scanning to (n+1)-th scanning, the line printed by the nozzle No. 1 is arranged adjacent to the line printed by the nozzle No. 2 at the time of n-th scanning. This is to ensure that four adjacent lines printed by four passes will not be printed by the ink particles discharged from the same nozzle, and that variations will be given to the errors caused by deviations in the position of arrival of ink particles discharged from the nozzle of the head h.

All the spaces between lines printed at the time of the n-th scanning are filled by the aforementioned four operations (four passes), whereby printing of one block terminates. The movement of the recording medium at the time of four-pass operation covers a short distance. After termination of the printing of one block by four passes, the recording medium is moved to the position of (n+4)-th scanning by the head h, as shown in the drawing, so that printing of the 2nd block is carried out in the same operation as above. This movement covers a long distance.

Assume, for example, that the head h has 128 nozzles and the space between nozzles is 140 microns. Then when 4-pass operation is performed as above, the three movements of the recording medium cover a short distance of 140+140/4=175 microns. In the fourth operation, the movement covers a long distance of (128−4)×140+140/4=17395 microns.

In the prior art, image quantity deterioration caused by feed error, such as a white stripe occurring between blocks, was observed during this long distance movement. In the present embodiment, the aforementioned mark M is recorded on the recording medium from at last one of the nozzles during printing, and the recording medium is accurately moved by the subsequent operation. It is sufficient that at least one mark M is recorded during printing of one block, before long distance movement, for example, in the case of the aforementioned block printing. Further, if it can be recorded from a particular nozzle at a specifically timed interval, it may be recorded at any timing during the process of printing. FIG. 7 shows the case where a linear mark M having a predetermined length in the main scanning direction is recorded on the non-printing area, from the nozzle No. m located at the backward end of the head h in the sub-scanning direction at the time of the first scanning during printing of one block.

Figure 8:
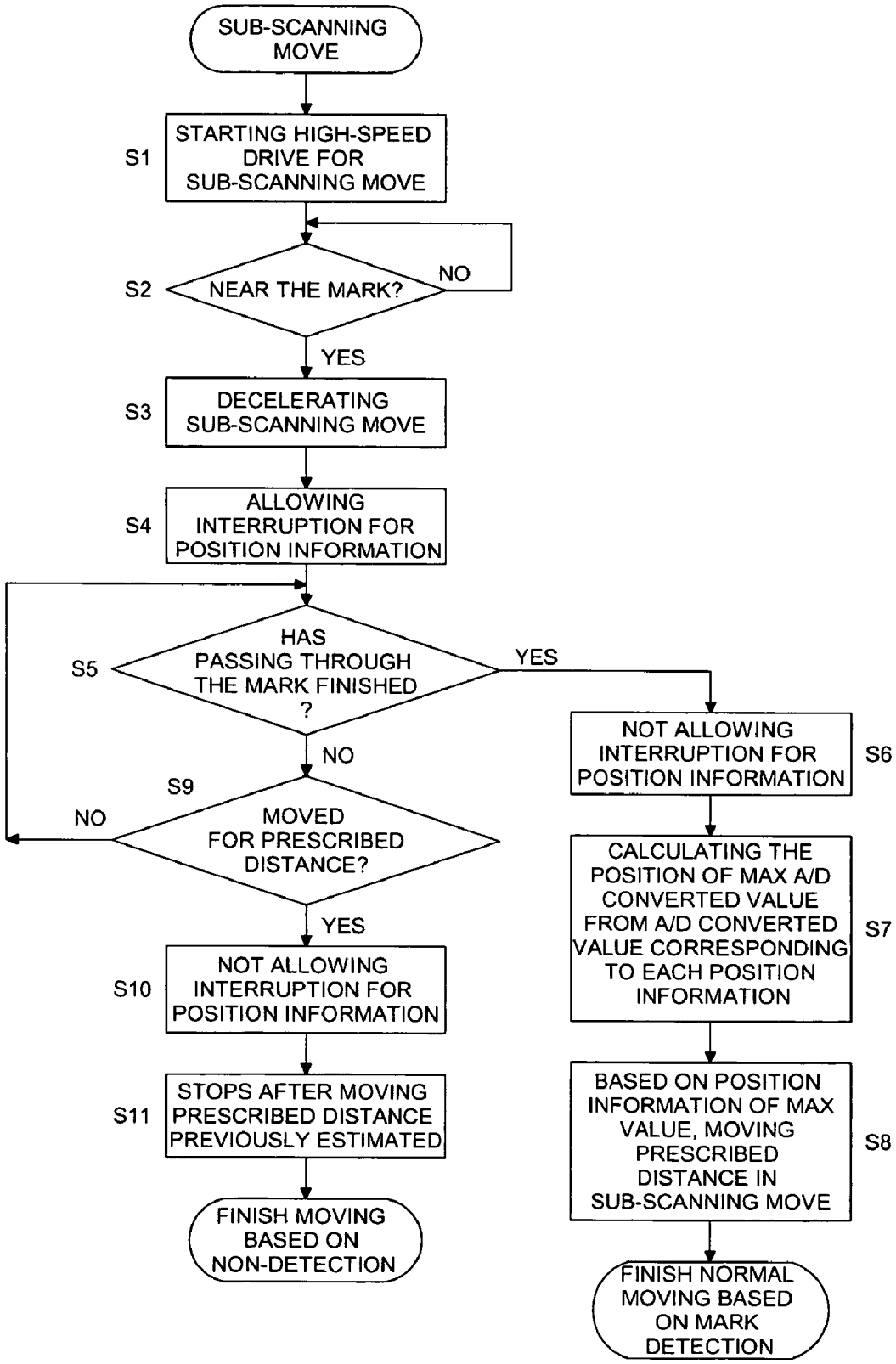
FIG. 8 is a flowchart showing the control operation when moving a recording medium.
Figure 9:
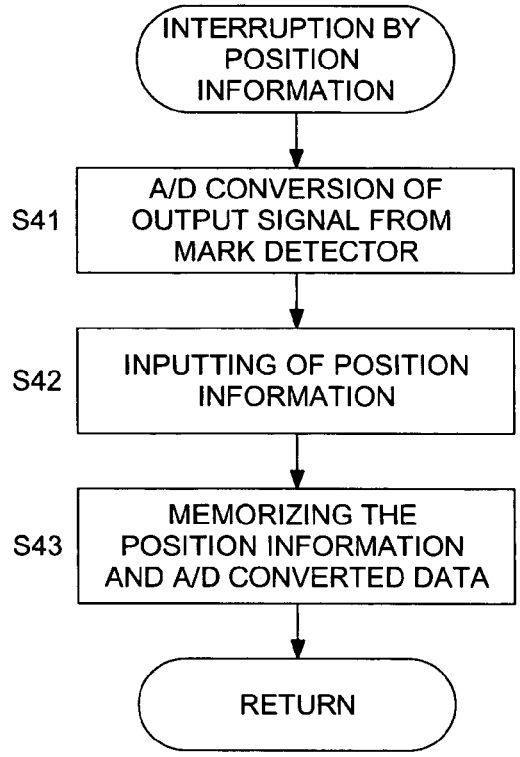
FIG. 9 is a flowchart showing the control operation when moving a recording medium.

FIGS. 8 and 9 are flowcharts showing the control operations ranging from the final n+3rd scanning during one-block printing by the head h to the first (n+4)-th scanning during the next block printing, at the time of long distance movement of the recording medium. Referring these flowcharts and FIGS. 1, 2 and 7, the following further describes the control operations:

Upon termination of one-block printing by four passes, the controller 10 controls the sub-scanning driven section 17 to drive it, and to drive the sub-scanning motor 18 at a high speed. It moves the recording medium at a high speed in the sub-scanning direction so that the position recorded with the mark M will come close to the mark detector 19 mounted on the recording head H (S1).

The pulses of the rotary encoder in the movement of the recording medium P are counted. This provides detection to see if the mark M has come close to where it is detected by the mark detector 19 or not. Thus, when the controller 10 has counted the pulses of the rotary encoder to identify that the mark M has come close to where it is detected by the mark detector 19 (S2), it switches the speed of the sub-scanning motor 18 to a low speed, in order to ensure precision detection of the mark M by the mark detector 19 (S3). At the same time, the controller 10 allows interruption of position information for recording medium P to execute interruption shown in FIG. 9 (S4).

As described above, the recording medium P is moved at a high speed close to where the mark M is detected, and is moved at a low speed when it has come close to that position. This procedure is preferred, because it ensures the precision detection of the mark M, and at the same time, reduces the time of movement, thereby cutting down the recording time.

During the movement of the recording medium P, the recording head H is waiting at the position where detection light emitted from the mark detector 19 passes over the mark M recorded on the recording medium P (non-printing area of the recording medium P in this case). The analog detection signal detected by the mark detector 19 is amplified by the AMP 21, and is then fed to the A/D converter 22, where it is converted into the digital signal (S41).

Here the controller 10 allows the A/D converter 22 to convert the analog output signal from the mark detector 19 into the digital signal, immediately before the position where the mark M is estimated to be detected, at timed intervals when the position information 20*a* is outputted. It allows inputting of the position information 20*a* from the encoder sensor 20 corresponding to the sampling data of each output value (S42), and memorizes this position information 20*a* and the output value subjected to A/D conversion by the A/D converter (S43). The memorized data is stored in a predetermined storage area of the controller 10.

Returning to the flowchart in FIG. 8, the recording medium P is fed in the sub-scanning direction. When the mark detector 19 has passed through the mark M (S5), the interruption of the position information 20*a* is disabled to terminate the interruption of the position information 20*a* (S6). Then based on the A/D converted value (sampling data) for each position information 20*a*, the controller 10 calculates the position information corresponding to the peak A/D converted value (S7). The position information obtained by this calculation is stored in a predetermined storage area of the controller 10.

The calculated position information concerns the center of the mark M, and the controller 10 uses this position information as a reference position for moving the recording medium P over a long distance. To put it another way, the controller 10 controls the sub-scanning driven section 17 to drive it so that the sub-scanning motor 18 is driven. This control operation moves the recording medium P in the sub-scanning direction. The encoder sensor 20 starts counting of the pulses of the rotary encoder, from the position indicated by the aforementioned position information. The mark M is recorded at specifically timed intervals (the first scanning of one block from the nozzle No. m of the head h in FIG. 7), from a specific nozzle. This shows the required number of the counts corresponding to the distance over which movement should be performed from the position indicated by the position information wherein the peak position of the mark M has been detected, in order to move it to an appropriate position where the first scanning ((n+4)-th scan in FIG. 7) for the printing of the next block should be performed.

The controller 10 stores the counts (predetermined counts) up to the aforementioned appropriate position. By allowing the encoder sensor 20 to count the pulses of the rotary encoder, the controller 10 moves the recording medium P from the position indicating the peak of the mark M over a distance corresponding to the specified counts (S8), and terminates the normal movement operation through detection of the mark M.

Once adjusted, the distance from the mark detector 19 to the position where the mark M recorded on the recording medium P has been detected is fixed by the mark detector 19 and mark M recorded position; therefore, it is constant independently of the environment or the mechanical errors in the rollers R1 and R2. Even when the recording medium P is moved a long distance close to the head length in the sub-scanning direction, only a small traveling error occurs, with the result that drastic reduction of the feed error is achieved for long-distance movement. Even when printing of the next block is started by the recording head H, this arrangement allows printing, without white stripe being produced between this block and the previously printed block.

In the step S5, after starting the interruption of the position information, the recording medium P is moved predetermined distance (the distance where the detection light of the mark detector 19 is estimated to pass through the mark M). It may occur that correct detection of the mark M by the mark detector 19 cannot be achieved because the mark M is not recorded on the recording medium P for some reason or the mark M has been erased, although the recording medium P has been moved to the position where the mark M is to be detected (S9). In this case, the processing of the position information interruption started in the aforementioned Step S4 is disabled and the recording medium P is moved based on the moving distance.

As described above, the controller 10 stores the position information wherein the peak position of the mark M has been detected. Based on the position information for detecting the previous peak position of the mark M having been stored and the aforementioned predetermined counts, it is possible to identify the moving distance of the recording medium P in the case of long-distance movement. Even if the mark M cannot be detected correctly, the controller 10 controls the drive of the sub-scanning driven section 17 and sub-scanning motor 18, based on the previous moving distance, whereby the recording medium P can be moved without noticeable error.

After the aforementioned movement, the controller 10 stops the drive (S11) and terminates the movement when the mark M is not detected.

In the present invention, when the controller 10 has acquired sufficient information to calculate the peak position of the output detected by the mark detector 19, the A/D converter 22 is preferred to stop the A/D conversion of output signal from the engine mark detector 19. This arrangement eliminates the waste of time in data processing and reduces the storage capacity for storing the sampling data.

In the present embodiment, filtering means is preferably installed to filter the output value from the A/D converter 22. This filtering means provides filtering operation according to the estimated waveform of regular distribution of the data subjected to A/D conversion, thereby removing the incorrect operation due to uncertain factors resulting from spike noise, with the result that further improvement in reliability and precision has been achieved. Such filtering means can be provided by installing a low-pass filter as software on the controller 10.

In the aforementioned description, the mark M is recorded in the non-printing area outside the printing area on the recording medium P, as shown in FIG. 2. When a "borderless image" is formed where the image is recorded across the full width of the recording medium P, the entire surface of the recording medium P is used as a printing area, so it is not possible to use the aforementioned method where the mark M is recorded in the non-printing area and is detected. For this reason, when a "borderless image" is to be formed, this mark M is preferably recorded on the upstream side in the recording medium P transport direction, rather than in the area where the mark M is recorded by the main scanning of the recording head H.

Recording by the recording head H is not yet performed in the area in the recording medium P transport direction upstream from the area for recording by main scanning of the recording head H. If the mark M is recorded in this area and the recording medium P is subsequently fed in the sub-scanning direction, this mark M can be detected when the mark detector 19 passes over the mark M. Moreover, when the image is recorded by the main scanning of the recording head H subsequently, the mark M is embedded in the image and cannot be easily observed on the image.

Figure 10:
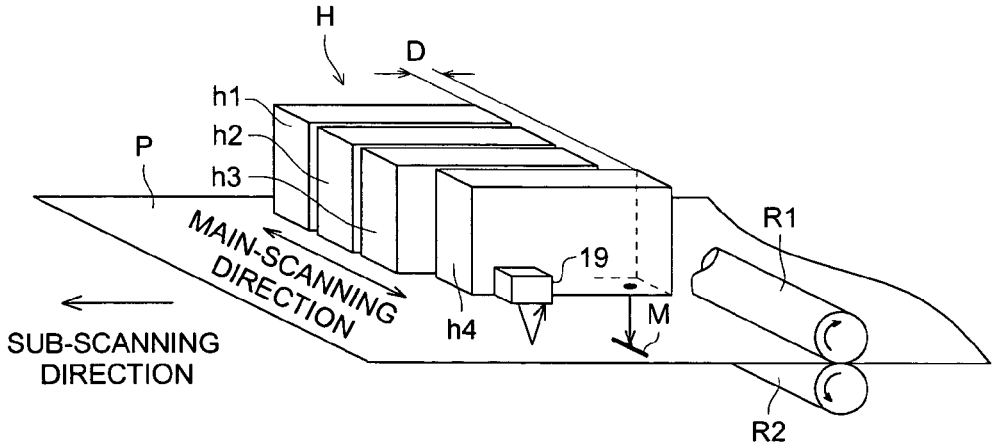
FIG. 10 is a configuration diagram showing another embodiment of the inkjet recording apparatus of the present invention.

Referring to FIG. 10, the following describes the recording by the recording head H is not yet performed in the area in the recording medium P transport direction upstream from the area for recording by main scanning of the recording head H. The same numerals of reference as those of FIG. 1 indicate the same configuration, and will not be described to avoid duplication.

As shown in FIG. 10, the recording head H, consisting of four heads h1 through h4, provided with nozzles for recording a mark M on the recording medium P by discharging ink particles (head h4 in this case, without being restricted thereto) is installed on the upstream side in the recording medium transport direction, in the form misaligned a predetermined amount with respect to other heads h1 through h3. The amount of misalignment (D), if excessive, will lead to increase in the overheads at the start and end of writing, giving an adverse affect to printing time. To solve this problem, the amount of misalignment should be equal to or greater than the space of one nozzle of the head h for recording the mark M, or preferably, equal to or greater than that of one nozzle, without exceeding the space of N/5 nozzles, where "N" denotes the number of nozzles per head.

Of the recording heads H, the recording head h4 having the nozzle for recording the mark M is installed on the upstream side in the recording medium transport direction, in the form misaligned by the amount equal to or greater than the space of one nozzle, with respect to other heads h1 through h3. This arrangement allows the head 4 record the mark M recorded, at a position the amount of misalignment (D) ahead, on the upstream side in the recording medium P transport direction. The area where the mark M is recorded ahead is where recording is not yet performed on the recording medium P. When the recording medium P is fed in the sub-scanning direction, it can be detected by the mark detector 19. After that, when the recording head H has undergone main scanning, the mark M is embedded in the image.

As described above, the area where the mark M is recorded is located within the printing area of the "borderless image". So although the mark M is embedded in the image by the subsequent main scanning of the recording head H, the mark M should be recorded in a sufficiently small area that permits the mark M to be detected by the mark detector 19, in order to minimize the adverse effect upon the image. To record the mark M in such a sufficiently small area, it is preferred that the data corresponding to the nozzle for recording the mark M be discharged in the main scanning direction over the distance required to record the mark M.

Figure 11:
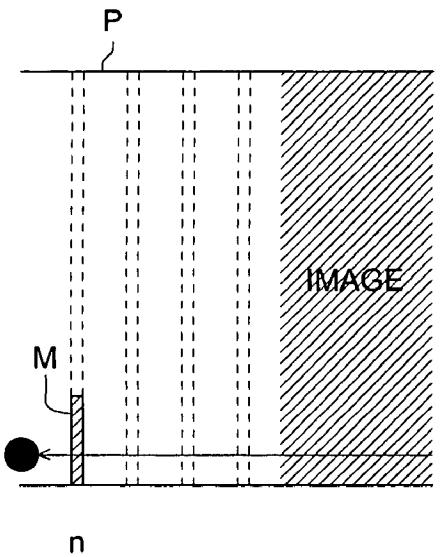
FIGS. 11(*a*) through (*c*) are drawings representing the state of recording the mark when recording a borderless image.
Figure 11:
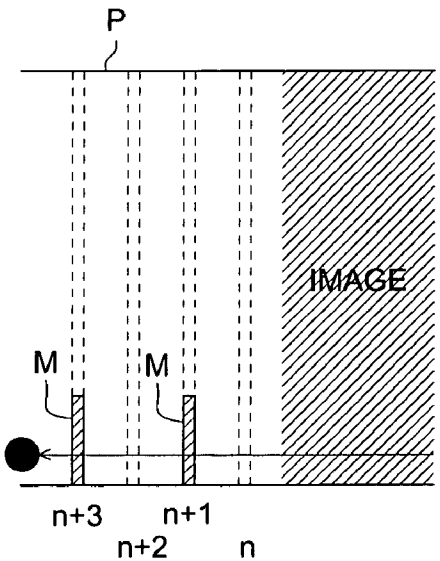
Figure 11:
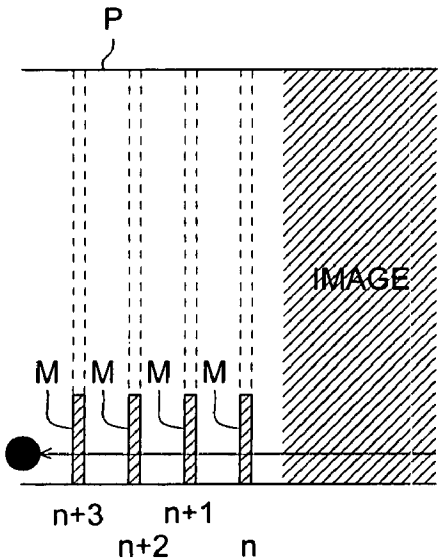

FIG. 11 shows the mode of recording the mark M when recording the borderless image. When this borderless image is recorded, the methods of recording the mark M includes the following: One mark M is recorded from one nozzle of one head, as shown in (a); one mark M is recorded from alternate nozzles of multiple adjacent nozzles on one head (two nozzles in this embodiment) of one head, as shown in (b); and multiple marks M are recorded at one time from multiple adjacent nozzles on one head (four nozzles in this embodiment) of one head, as shown in (c).

When a plurality of marks M have been recorded to ensure high-precision feed, the spot diameter of the detection light by the mark detector 19 is preferably smaller than the space of each mark M in the sub-scanning direction, and the data corresponding to the nozzle for recording the mark M is preferably discharged over the distance required for recording the mark M in the main scanning direction. This arrangement allows the mark M to be recorded in a sufficiently small area, and each of a plurality of marks M can be detected by the detection light thoroughly. These nozzles are controlled by the controller 10 (shown in FIG. 1).

The method of detecting the position information in the inkjet recording apparatus of the present invention described above is not restricted to the one of counting the pulses of the rotary encoder. When a stepping motor is used as the sub-scanning motor 18, it is possible to use the method of counting the step pulses applied to the stepping motor.

Further, the mark recording means for recording the mark M is not restricted to the one of using the function of the recording head H for image recording. If an arrangement allows a certain layout relationship to be maintained with the mark detecting section in the recording medium P feed direction, a separate configuration independently of the recording head H may be used. In this case, the position of recording the mark M is not limited to the image recording surface of the recording medium P; the mark M can be recorded on the back side. In this case, the mark detecting section is arranged on the back side of the image recording surface of the recording medium P.

Embodiment-2

The following describes the second embodiment. The same processes and apparatuses as those of the aforementioned first embodiment will not be described to avoid duplication.

The arrangement before the mark M on the recording medium is detected by the mark detector 19 is the same as that of the embodiment 1.

Figure 12:
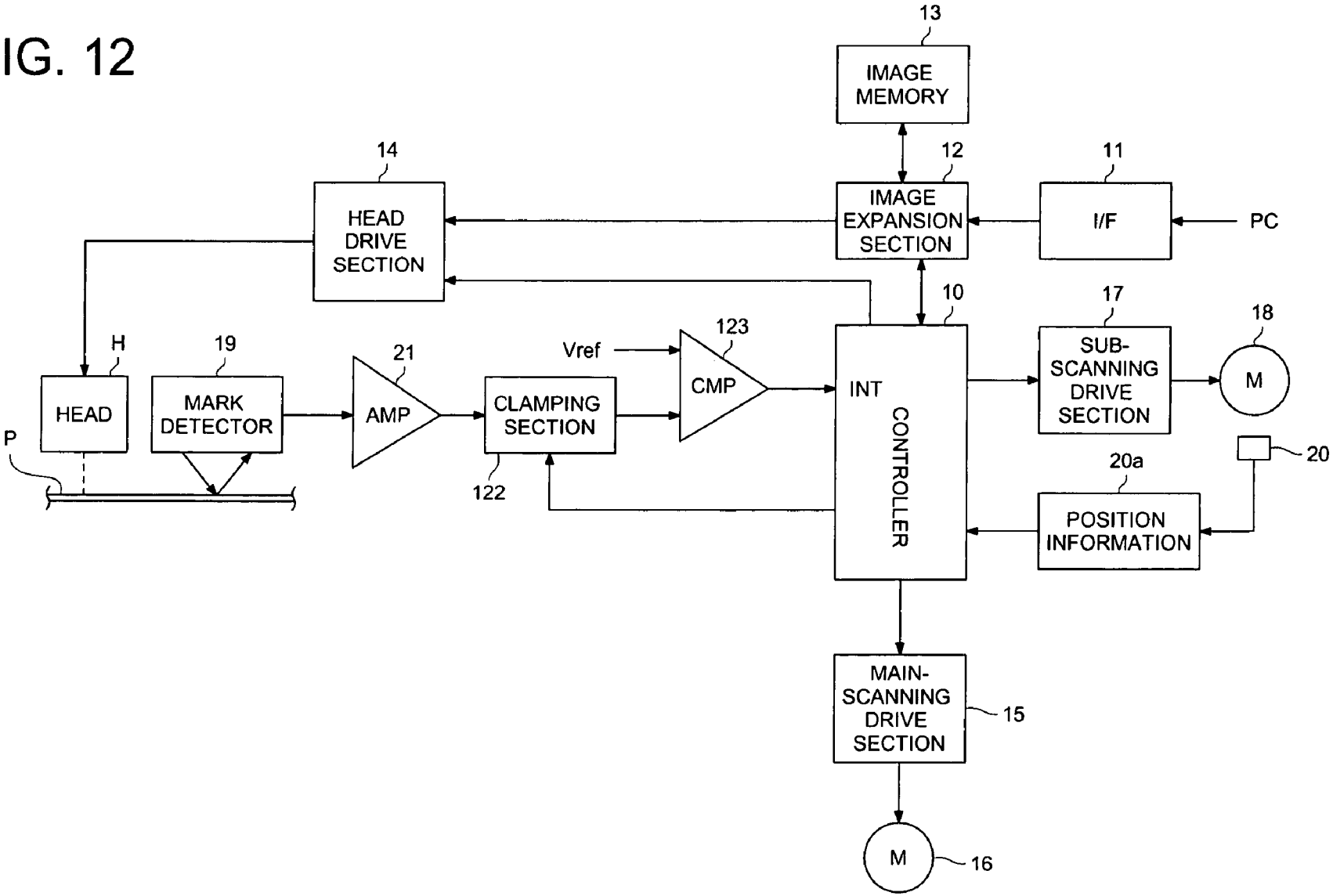
FIG. 12 is a configuration block diagram showing the configuration of an inkjet recording apparatus of the present invention.

The output signal issued when the mark M on the recording medium has been detected by the mark detector 19 is amplified to a predetermined signal level by the AMP 21 shown in FIG. 12. Then it is sent to a clamping section 122.

The present embodiment is provided with a rotary encoder (not illustrated) constituting the position information detecting section for the recording medium P. As shown in FIG. 12, the number of pulses of the rotary encoder outputted synchronously with the movement of the recording medium P by a pair of rollers R1 and R2 driven by the sub-scanning motor 18 is detected by the encoder sensor 20. The number of pulses detected by the encoder sensor 20 is outputted to the controller 10 as the position information 20*a* on the recording medium P corresponding to the moving distance of the recording medium P. This rotary encoder is installed to be synchronized with either the rollers R1 and R2 or sub-scanning motor 18.

In the clamping section 122, the output signal of the mark detector 19 amplified by the AMP 21 is clamped and the potential of that output signal is clamped.

If the mark M is recorded at specifically timed intervals from a specific nozzle, the approximate position is known in advance. Accordingly, by counting the pulses of the rotary encoder with the encoder sensor 20 when the recording medium P is moved, it is possible to determine if the mark M has come close to where it is detected by the mark detector 19. The output signal of the mark detector 19 by the clamping section 122 is clamped immediately before the position where the mark M is estimated to detected by the mark detector 19, by counting the pulses of the rotary encoder by the encoder sensor 20, wherein this clamping must be carried out at the portion of the recording medium P where the mark M and image are not recorded. This clamping operation is performed immediately before the position where the mark M is estimated to be detected by the mark detector 19, based on from the position information 20*a* from the encoder sensor 20, when a clamp instruction signal is outputted from the controller 10 to the clamping section 122.

This clamping section 122 is preferred to clamp the signal at the maximum or minimum potential after the position immediately before the mark M is estimated to be detected. If the detected potential of the recording medium on the non-printed portion is clamped at a certain value according to this arrangement, this will produce the same effect as when calibration has been carried out, with the result that accurate comparison to be described hereafter will be performed.

The output signal having been clamped by the clamping section 122 is sent to the comparing section (CMP) 123.

Figure 13:
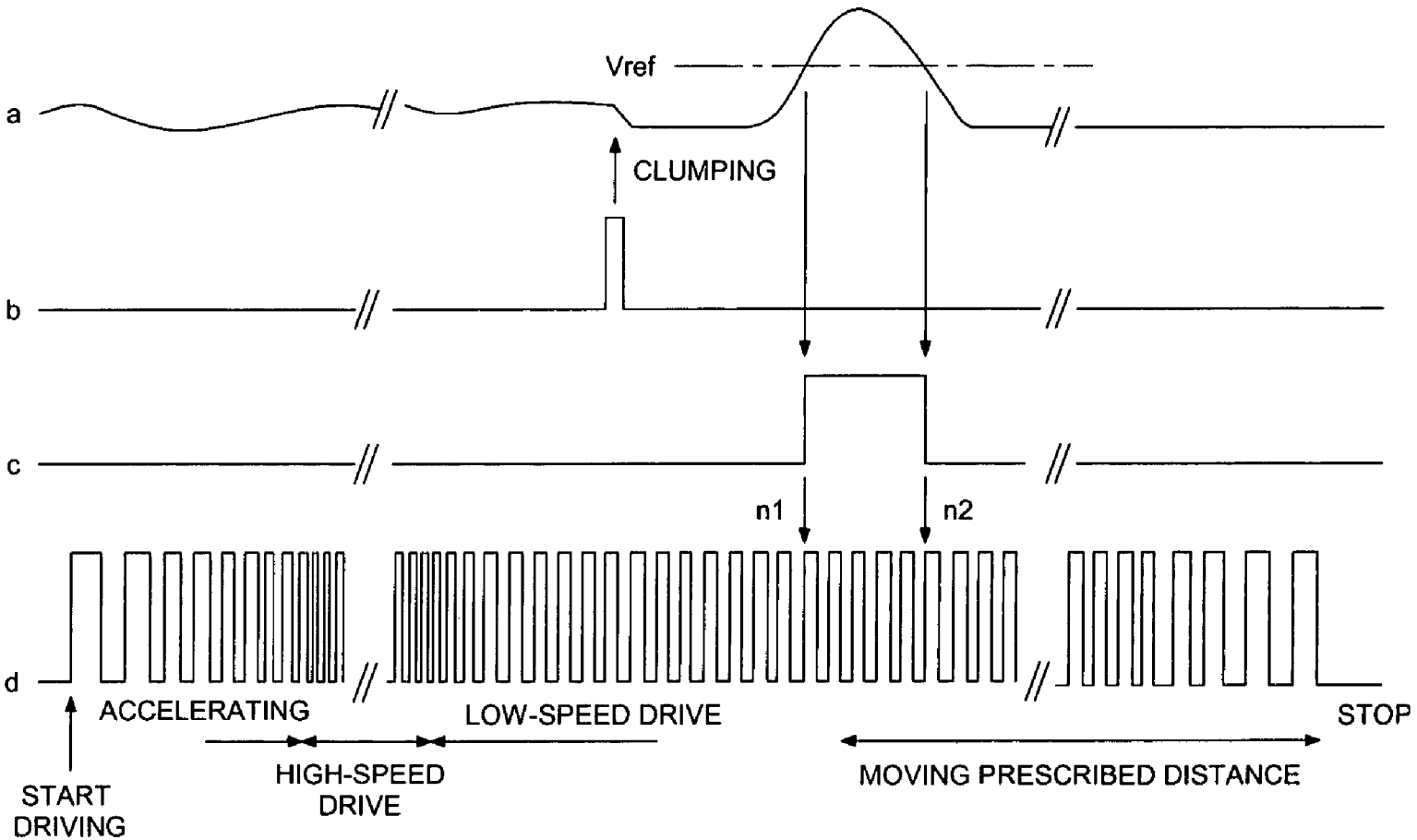
FIG. 13 is a time chart showing the state of output signals.

FIG. 13 is a time chart representing the state of each output signal. In the drawing, the signal "a" denotes the output signal from the mark detector 19, outputted from the clamping section 122 to the CMP 123 in FIG. 12. Signal "d" indicates a clamp instruction signal outputted from the controller 10 to the clamping section 122. The output signal when the detection light of the mark detector 19 has passed through the mark M on the recording medium P exhibits a waveform protruded in a conical form from the potential clamped at the position immediately before the mark M, as indicated by the signal "a" of FIG. 13. The CMP 123 compares this output signal with the reference signal Vref of a predetermined potential, thereby detecting the peak position of the output signal potential.

The term "predetermined potential" is used here in the sense of a value higher than the clamped potential and lower than the peak potential. The peak potential has a certain fluctuation resulting from the difference of the machine and environment, so this fluctuation must be subtracted to get the potential.

In the detection operation at the peak position, the CMP 123 compares the signal "a" as an output signal of the mark detector 19 with the aforementioned reference signal Vref, as shown in FIG. 13, and the signal "1*b*" as an output signal during the time period where the signal "a" reaches the reference signal Vref is outputted to the controller 10. Based on the position information 20*a* from the encoder sensor 20 indicated by the signal "c" in FIG. 13, the controller 10 reads the position n1 where the aforementioned reference signal Vref is reached when the signal "a" rises, and the position n2 when the signal "a" decays from the aforementioned reference signal Vref, and makes calculation from "max=(n1+n2)/2", assuming the intermediate position of the output signal of the mark detector 19 as the maximum output position (peak position).

The peak position information calculated in this stage is stored in a predetermined storage area in the controller 10.

Assuming the calculated peak position as the mark M position, the controller 10 determines the moving distance of the recording medium P by the aforementioned recording medium moving section, with reference to this position. The position of the mark M detected in the manner described above is detected by clamping the detection signal from the mark detector 19 at a predetermined potential by means of the clamping section 122. This arrangement ensures improved detection reliability, without being affected by the cockling of the recording medium P or the fluctuation of the detection potential that is changed by the fluctuation of the suction onto the platen.

The output signal clamped by the clamping section 122 is preferably masked, except for a predetermined distance, for example, 1.0 mm, from the position immediately before the mark M is estimated to be detected. Masking is defined as excluding the detection output within this range from the measured value. This arrangement deletes the influence of noise produced except for the vicinity of where the mark M is detected, and fluctuation of the detection potential.

The block printing method, as an example of the image recording method, as shown in FIG. 7, is the same as the above description, and will not be described to avoid duplication.

Figure 14:
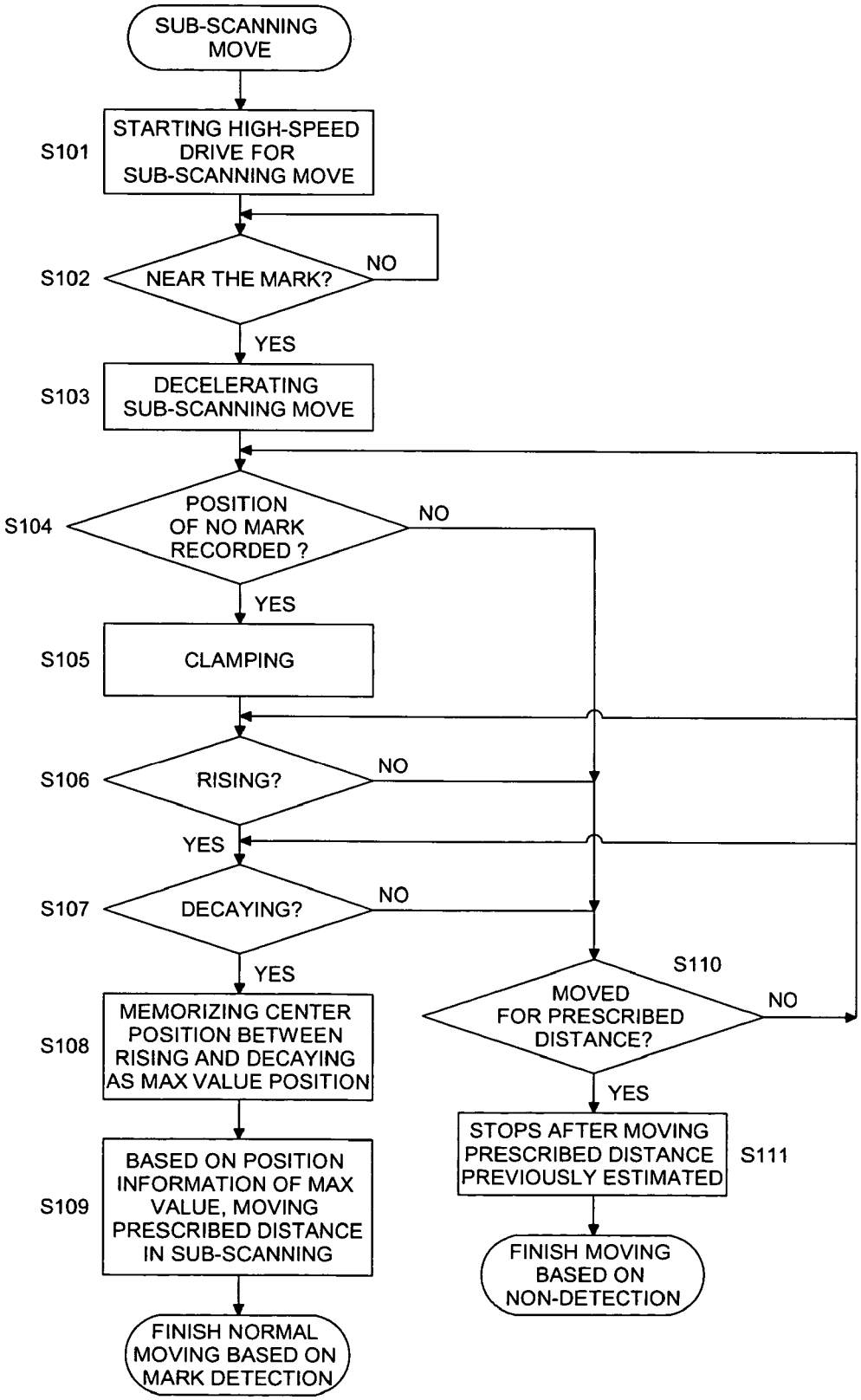
FIG. 14 is a flowchart representing control operation when moving a recording medium.

FIG. 14 is a flowchart showing the control operation from the final n+3rd scanning during the movement of the recording medium over a long distance, e.g. in the process of one-block printing by the head h, to the first n+4th scanning in the processing of printing the next block.

Upon termination of one-block printing by four passes, the controller 10 controls the drive of the sub-scanning driven section 17 so that the sub-scanning motor 18 is driven at a high speed. It moves the recording medium P at a high speed in the sub-scanning direction in such a manner that the position where the mark M is recorded will come close to the mark detector 19 provided on the recording head H (S101).

The pulses of the rotary encoder when moving the recording medium P are counted by the encoder sensor 20. This makes it possible to detect whether or not the mark M has come close to where it is detected by the mark detector 19. Thus, having determined, based on the counts of the pulses of the rotary encoder, that the recording medium P has moved close to where the mark M is detected by the controller 10 (S102), the controller 10 switches the drive speed of the sub-scanning motor 18 over to a low speed in order to ensure accurate detection by the mark detector 19, so that the recording medium P will be moved at a low speed (S103). As described above, the recording medium P is moved at a high speed up to the position close to where the mark M is detected. The speed is reduced when the recording medium P has come close to the point of detection. This arrangement cuts down the time of movement while ensuring accurate detection of the mark M, thereby reducing the reporting time.

When the recording medium P is moving, the recording head H is waiting where the detection light emitted from the mark detector 19 passes over the mark M recorded on the recording medium P (non-printing area in this case). In time, this mark M is detected by the mark detector 19. Based on the position information 20*a* from the encoder sensor 20, the controller 10 determines whether or not the current position is the non-record position where the mark M or image is not recorded, immediately before the mark M is detected (S104). If it is non-record position, a clamp instruction signal is outputted to the clamping section 122 (S105).

When the mark M has been detected by the mark detector 19 with the movement of the recording medium P, as described above, the CMP 123 outputs to the controller 10 the signal between the point of time when the rise of the output signal from the mark detector 19 having been clamped reaches the reference signal Vref, and the output signal from the mark detector 19 decays from the reference signal Vref resulting from subsequent movement of the recording medium P. Based on the decisions at the time of rise (S106) and decay (S107), the controller 10 reads each position from the position information 20*a* from the encoder sensor 20, thereby calculating the intermediate position of the output signal of the mark detector 19 (S108).

Since the calculated position information concerns the center position of the mark M, the controller 10 assumes this position information as the reference position for long-distance movement of the recording medium P. To put it another way, the controller 10 controls the drive of the sub-scanning driven section 17 so that the sub-scanning motor 18 is driven. This operation moves the recording medium P in the sub-scanning direction, and the counting of the pulses of the rotary encoder is started from the position indicating the aforementioned position information by the encoder sensor 20. The mark M is recorded at specifically timed intervals (the first scanning of one block from the nozzle No. m of the head h in FIG. 7), from a specific nozzle.

This shows the required number of the counts corresponding to the distance over which movement should be performed from the position indicated by the position information wherein the peak position of the mark M has been detected, in order to move it to an appropriate position where the first scanning ((n+4)-th scan in FIG. 7) for the printing of the next block should be performed.

The controller 10 stores the counts (predetermined counts) up to the aforementioned appropriate position. By allowing the encoder sensor 20 to count the pulses of the rotary encoder, the controller 10 moves the recording medium P from the position indicating the peak of the mark M over a distance corresponding to the specified counts (S109), and terminates the normal movement operation through detection of the mark M.

Once adjusted, the distance from the mark detector 19 to the position where the mark M recorded on the recording medium P has been detected is fixed by the mark detector 19 and mark M recorded position; therefore, it is constant independently of the environment or the mechanical errors in the rollers R1 and R2. Even when the recording medium P is moved a long distance close to the head length in the sub-scanning direction, only a small traveling error occurs, with the result that drastic reduction of the feed error is achieved for long-distance movement. Even when printing of the next block is started by the recording head H, this arrangement allows printing, without white stripe being produced between this block and the previously printed block.

In the aforementioned step S104, the non-record position is not detected; then the recording medium P has moved a predetermined distance, but the non-record position still remains unchecked (S110). In this case, the recording medium P is moved based on the moving distance covered so far. In other words, as described above, the controller 10 stores the position information the position information wherein the peak position of the mark M has been detected. The moving distance of the recording medium P in the long-distance movement can be obtained from the position information having detected the peak position of the previous mark M and the aforementioned counts. Thus, the controller 10 controls of the drive of the sub-scanning driven section 17 and sub-scanning motor 18, based on the moving distance covered so far, even when the mark M is not detected. Thus, the recording medium P can be moved without any crucial error.

After the aforementioned movement, the controller 10 stops the drive (S111) and terminates the movement when the mark M is not detected.

If, as a result of comparison between the output signal of the mark detector 19 and reference signal Vref in the steps S106 and S107, rise or decay cannot be detected for some reason, the recording medium P is moved according to the moving distance covered so far, through steps S110 and S111 in the same manner as above.

Figure 15:
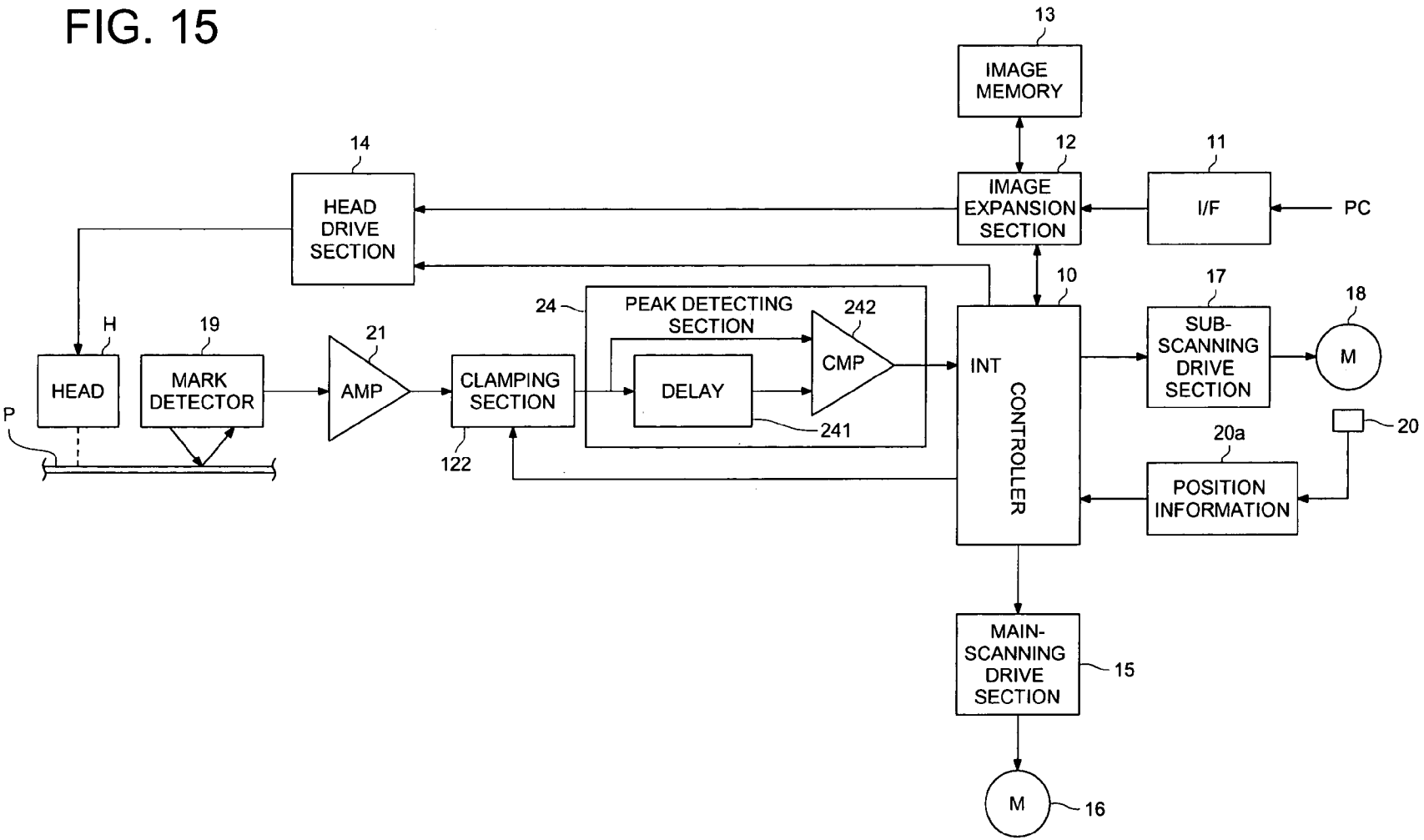
FIG. 15 is a configuration block diagram representing still another embodiment of the inkjet recording apparatus of the present invention.

FIG. 15 is a configuration block diagram representing still another embodiment of the inkjet recording apparatus of the present invention. The same configurations as those of FIGS. 1 and 13 are assigned with the same numerals for reference.

In this embodiment, the output signal of the mark detector 19 having been clamped by the clamping section 122 is sent to a peak detecting section 24, where peak position is detected.

Figure 16:
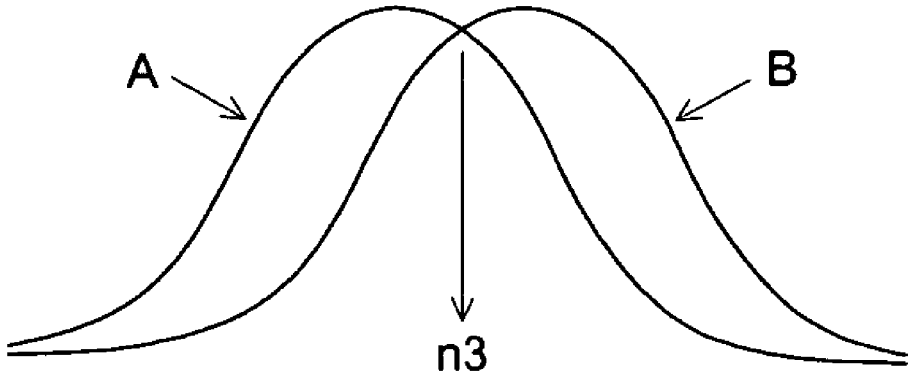
FIG. 16 is a drawing representing the detection of a peak position in the peak detecting section.

The peak detecting section 24 is provided with a delay section 241 and CMP 242. The output signal A having been clamped by the image expansion section 12, without being passed through the delay section 241, and the output signal B delayed a predetermined time obtained by passing the same output signal as the above-stated one through the delay section 241 are inputted in the comparing section (CMP) 242 (FIG. 16). The output signal from the mark detector 19 exhibits a waveform protruded in a conical form when the mark M has been detected. Thus, the decay of the output signal A crosses rise of the output signal B. The CMP 242 compares both output signals to output to the controller 10 the information on the position (n3) where the decay of the output signal A crosses rise of the output signal B.

The controller 10 detects the aforementioned position (n3) according to the position information 20*a* from the encoder sensor 20, and assumes it as the maximum output position of the output signal A. This position is identified as the position of the mark M.

The method of detecting the information on the position of the mark M in an inkjet recording apparatus of the present invention is not limited to the one of counting the pulses of the rotary encoder. When a stepping motor is used as the sub-scanning motor 18, it is possible to use the method of counting the step pulses applied to the stepping motor.

Further, the mark recording means for recording the mark M is not restricted to the one of using the function of the recording head H for image recording. If an arrangement allows a certain layout relationship to be maintained with the mark detecting section in the recording medium P feed direction, a separate configuration independently of the recording head H may be used. In this case, the position of recording the mark M is not limited to the image recording surface of the recording medium P; the mark M can be recorded on the back side. In this case, the mark detecting section is arranged on the back side of the image recording surface of the recording medium P.

The above description refers to the method of fixing the potential of the clamping position. It is also possible to use the method of clamping the minimum or maximum potential of the output signal at a certain potential within a certain range (from the time point of clamping to peak detection and thereafter) in the aforementioned example. This method also provides the similar effects.

Embodiment-3

Figure 17:
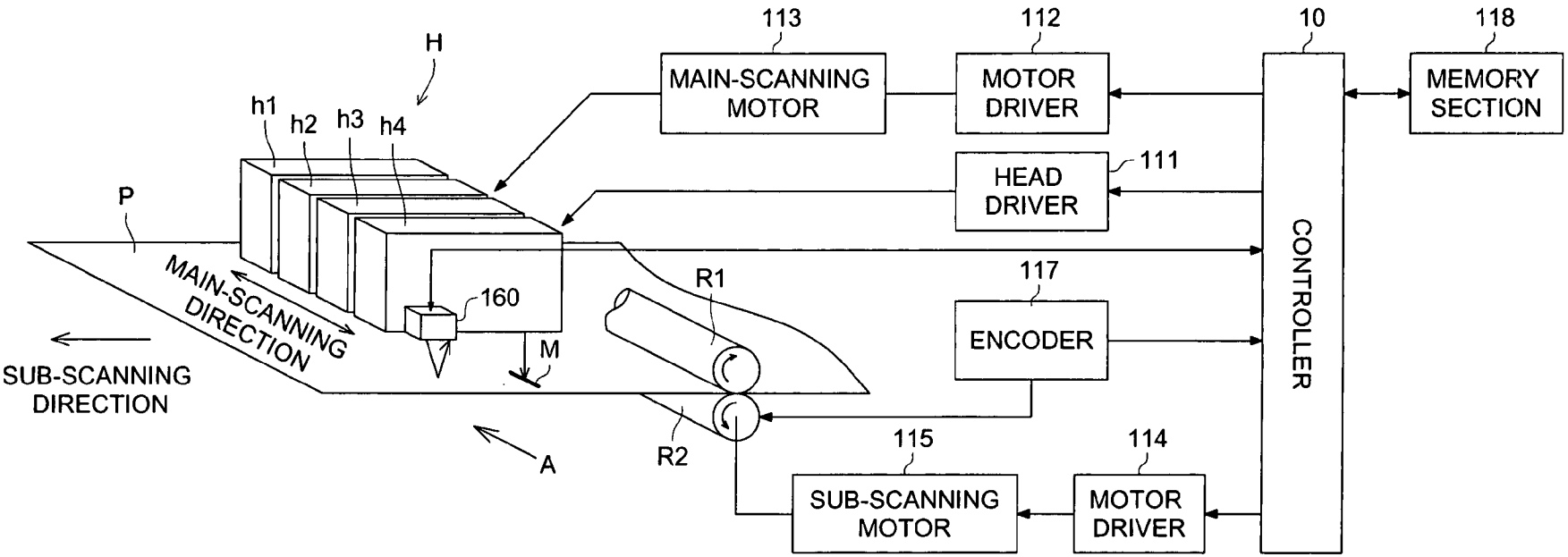
FIG. 17 is a configuration diagram showing the overview of the inkjet recording apparatus of the present invention.
Figure 18:
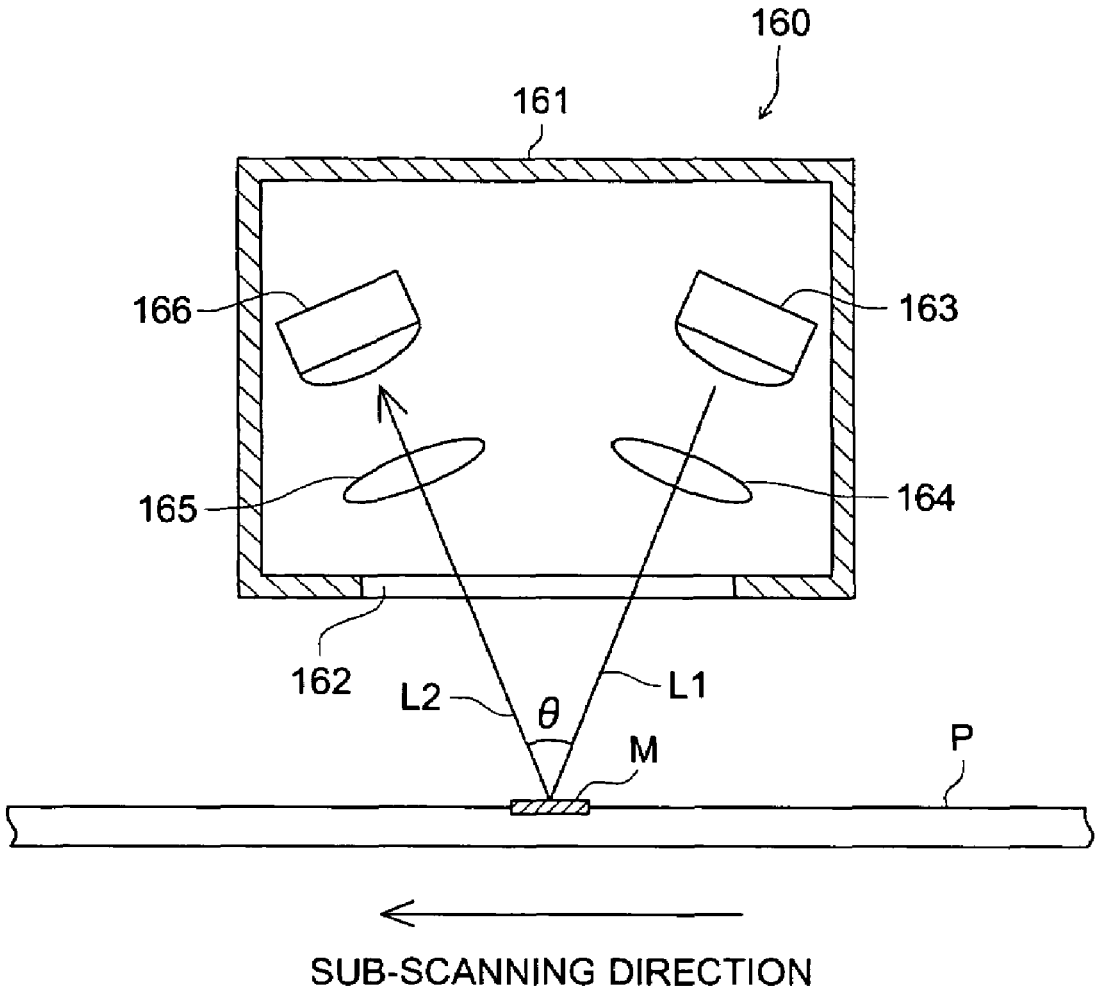
FIG. 18 is a drawing showing the construction of an optical sensor.

As shown in FIG. 17, a mark detector 160 as mark detecting means is provided on either one end of the recording head H in the main scanning direction. As shown in FIG. 18, this mark detector 160 consists of a reflection type optical sensor comprising:

a light emitting device 163 for emitting detection light for applying detection light obliquely to the surface of the recording medium P through the opening 162;

a condensing lens 164 for condensing and converging the detection light on the surface of the recording medium P;

a condensing lens 165 for condensing the reflected light formed by reflection of the detection light from the surface of the recording medium P; and a light receiving device 166 for receiving the detection light condensed by the condensing lens 165; they are contained in the casing 161. The mark M is detected by detecting the change in the amount of light when the detection light irradiated on the recording medium P has passed through the mark M on the moving recording medium P. The output signal from the mark detector 160 is inputted in the controller 10, which determines if the mark M is detected or not.

When the mark M is recorded by the yellow ink, it is preferred that the blue LED (having a wavelength of 460 nm through 500 nm) be used as a light emitting device (light emitting device) 163 used in this mark detector 160, in order to ensure satisfactory detection of the mark M. Further, the light receiving device 166 is preferred to be a blue one, i.e. a light receiving device having sensitivity to the light of the wavelength emitted by the aforementioned blue LED. A photosensor is commonly used as the light receiving device 166.

The mark detector 160 as mark detecting means is preferred to perform the functions of a sensor as recording medium detecting means for detecting the presence/absence of the recording medium P, i.e. for determining whether or not the recording medium P has been sent to the position where the recording medium P is recorded by the recording head H. Since it can perform the functions of a sensor as recording medium detecting means, the number of parts is reduced to improve cost cutting effects.

The mark detector 160 is also preferred to perform the functions of a sensor as both-directional position detecting means for alignment of the recording head H with respect to the recording medium P in both directions. To put it another way, when the recording head H moves in the main scanning direction, the positions of both sides of the recording medium P is detected by this mark detector 160, whereby alignment of the recording head H in both directions can be carried out. In the similar manner as above, use of the mark detector 160 to perform the functions of a sensor allows the number of parts to be reduced, with the result that cost cutting effects can be improved.

Needless to say, it is preferred that the mark detector 160 combine the functions of the sensor as recording medium detecting means and the sensor as both-directional position detecting means, because the effect of cutting down the number of parts used is even more improved.

Figure 19:
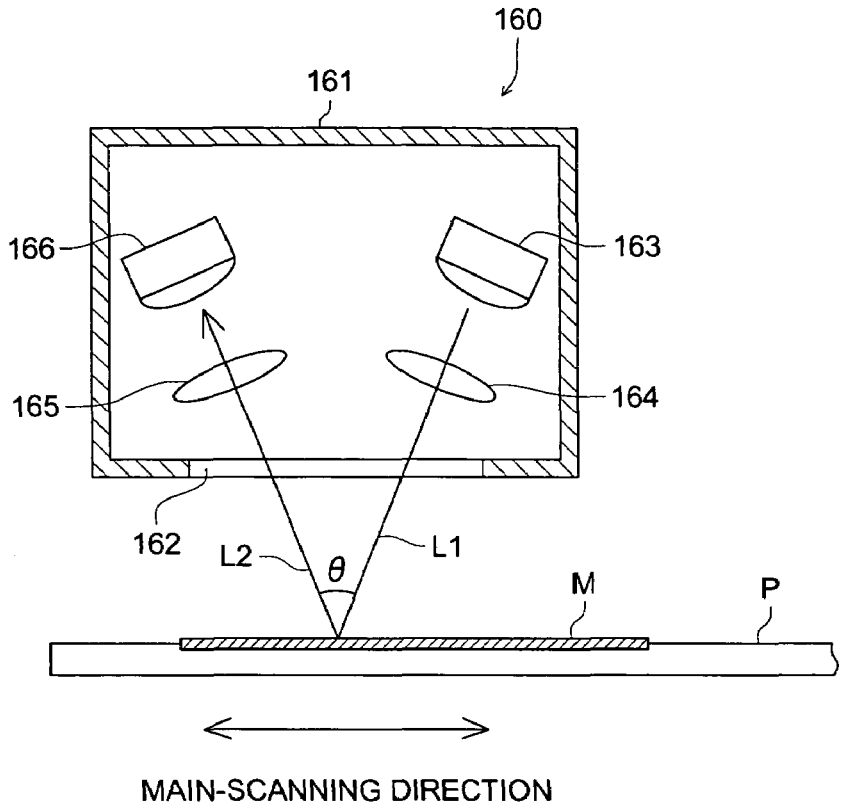
FIG. 19 is a drawing showing the layout configuration of the optical axis of the optical sensor as viewed from the sub-scanning direction.

The mark detector 160 shown in FIG. 18 is arranged in such a manner that the optical axes L1 and L2 of the detection light, emitted from the light emitting device 163 and received by the light receiving device 166, are opposite to each other at an angle θ in the sub-scanning direction. Without being restricted to this configuration, as shown in FIG. 19, the mark detector 160 may be installed to be oblique with respect to the surface of the recording medium P in the main scanning direction. To put it another way, the light emitting device 163 and light receiving device 166 are arranged so that the optical axes L1 and L2 having an angle θ are opposite to each other in the main scanning direction. Thus, when the optical axes L1 and L2 of the detection light are oblique in the main scanning direction orthogonal to the direction where the recording medium P is transported, then there will be little influence of the fluctuation in the height of the surface of the recording medium P in the sub-scanning direction. Thus, detection with very limited errors can be provided by the light receiving device 166.

Figure 20:
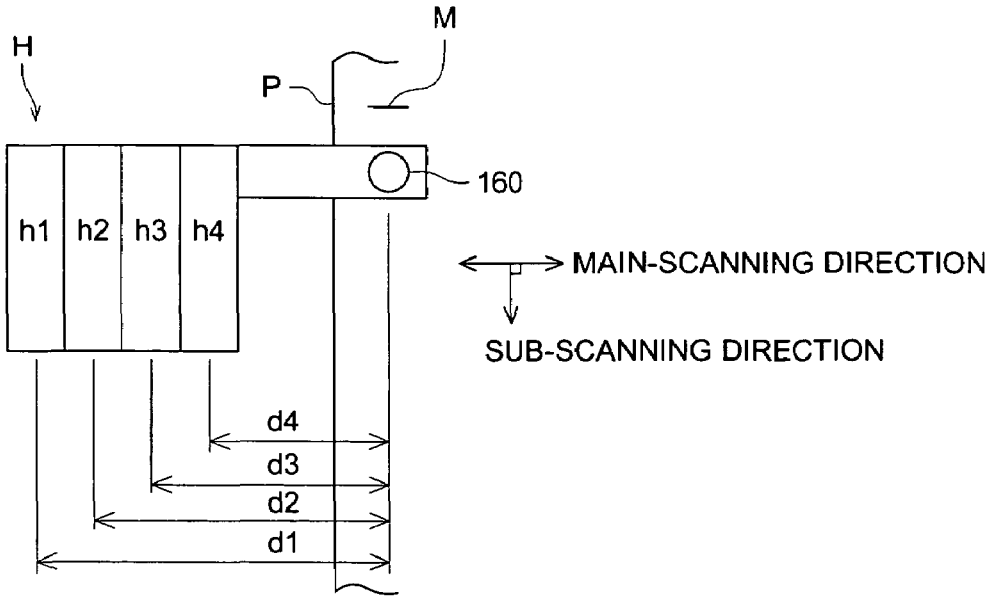
FIG. 20 is a schematic view showing the layout relationship between the optical sensor and recording head.

FIG. 20 is a schematic view showing the layout relationship between the mark detector 160 and recording head H. The mark detector 160 as mark detecting section is located at a distance equal to or greater than the "accelerated moving distance of the recording head H" by recording head moving means, in terms of "the space with respect to the recording head H in the main scanning direction".

To put it more specifically, "the space (of the mark detector 160) with respect to the recording head H in the main scanning direction" in the above description refers to the shortest distance between the flat plane vertical to the image recorded surface of the recording medium P and the mark detector 160, wherein the line connecting the centers of nozzles on the nozzle surface of the recording head H is included. The position of the mark detector 160 is the center of the spot-shaped detection light when the detection light emitted from the light emitting device 163 is applied to the recording medium P.

Further, when the recording head H consists of a plurality of heads as shown in the present embodiment, the nozzle surface refers to the nozzle surface of the head for recording the mark M. For example, FIG. 20 shows the case where the recording head H having a plurality of heads h1 through h4 are stopped on the left side of the recording medium P. The space between the mark detector 160 and the recording head H (head h4) in the main scanning direction, when the head h4 of these heads is assumed as a head for recording the mark M, is represented as space d4 in FIG. 5, where the recording head H and recording medium P are viewed from the plane.

Figure 21:
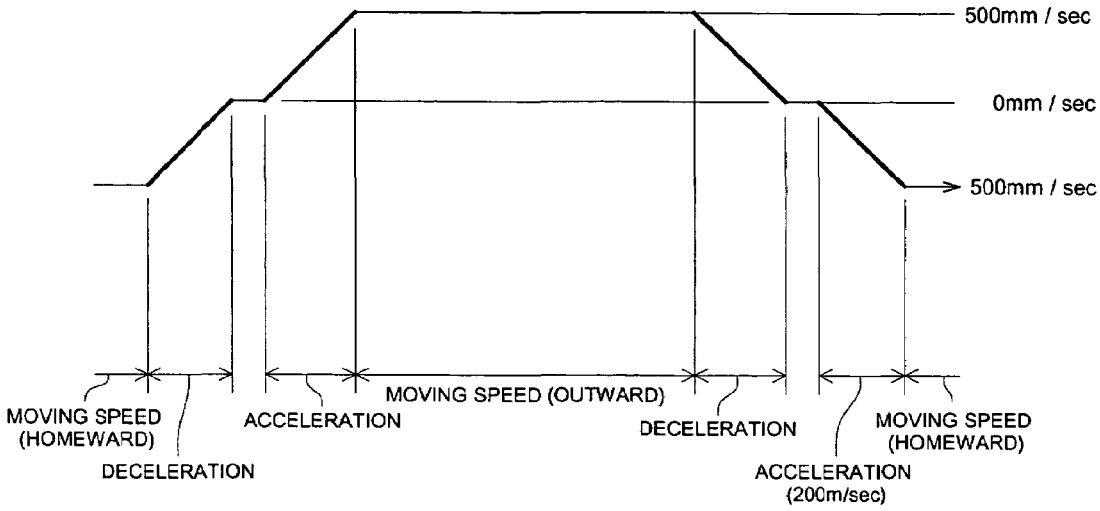
FIG. 21 is a drawing showing the relationship between the speed and time of reciprocating motion of the cartridge.

The "accelerated moving distance of the recording head H" can be defined as follows: The minimum moving distance and moving time for acceleration and deceleration are generally required in the reciprocating motion of a cartridge with a recording head H mounted thereon. As shown in FIG. 21, in this case, the speed is changed from the rest state at a speed of 0 (reverse position) to the traveling speed through a certain acceleration time (on the forward path). Then, after the lapse of a predetermined acceleration time, the speed reaches the traveling level (constant speed) (on the return path). Thus, the "accelerated moving distance of the recording head H" in the above description is defined as the minimum moving distance required for acceleration from the speed of 0 in the rest state to the constant traveling speed that allows image recording to be started from a position close to the printing area. This accelerated traveling distance is determined by the carriage weight, inertia moment and motor torque. This accelerated moving distance gives influence to the vibration and noise of the recording apparatus, so the optimum value is selected for each recording apparatus.

As shown in FIG. 21, assume that the carriage traveling speed is constant 500 mm/sec. in the image recording mode on the forward and return paths, and acceleration time from the rest state to the constant traveling speed is 200 m/sec. Then the accelerated moving distance ("d") required for the acceleration during this time is 50 mm.

As shown in FIG. 20, when the recording head H having heads h1 through h4 is stopped on the left side of the recording medium P, the space d4 between the head h4 located at the leading position in the traveling direction for the next image recording operation and the mark detector 160 is set to 50 mm, the same distance as the accelerated moving distance d4. Then the recording head H having moved to the left side of the recording medium P is reversed immediately when the mark M recorded on the recording medium P has been detected by the mark detector 160. The next recording operation can be started immediately after coming close to the printing area, after passing through the mark M recorded position on the side end of the recording medium P. Thus, there is no waste of time in the operation of the cartridge to detect the mark M. There is no concern about possible reduction in printing productivity.

As described above, when the space between the mark detector 160 and the recording head H in the main scanning direction is the same as the accelerated moving distance, there is agreement between the position where the mark M can be detected by the mark detector 160 on the side of the recording medium P and the position of carriage reversing, thereby minimizing the waste of time in cartridge operation;

this arrangement is preferred in this respect. As shown in FIG. 20, if, of the heads h1 through h4, the head h3 is the head for recording the mark M, then the space d3 between the mark detector 160 and the head 3 in the main scanning direction is greater by the head space "r" (d3+d+r) than the accelerated moving distance d (=d4) where the image can be recorded by the head h4 at the leading position in the traveling direction during the movement toward the recording medium P, when the recording head H is stopped on the left side of the recording medium P. Similarly, if the head h2 is the head for recording the mark M, then the space d2 between the mark detector 160 and head 2 will be d2=d+2r. If the head h1 is the head for recording the mark M, then the space d1 between the mark detector 160 and head 1 will be d1=d+3r. The space d4 between the head h4 at the leading position in the traveling direction and the mark detector 160 is the same as the accelerated moving distance d; therefore, the position for detecting the mark M by the mark detector 160 on the side of the recording medium P is matched with the cartridge reversing position.

Even if the space d4 between the head h4 at the leading position in the traveling direction and mark detector 160 is made slightly greater than the accelerated moving distance d, the cartridge need not repeat start/stop operations for mark M detection, in addition to the reversing operation for reciprocating motion, if the cartridge reversing position in the reciprocating motion is matched to the position where the mark M can be detected by the mark detector 160. This arrangement minimizes the waste of time in cartridge operations.

When the marks M are recorded on the non-printing areas close to the both side ends, the optical sensor as mark detecting means may be arranged on both ends of the recording head H in the main scanning direction. FIGS. 22(*a*) and (*b*) are schematic plan views of the mark detectors 160*a* and 160*b* mounted respectively on both ends of the recording head H having heads h1 through h4 in the main scanning direction. The (a) and (b) show the recording head H stopped at the reversing positions on the forward path and return path, respectively.

As shown in FIG. 22(*a*), when the recording head H is stopped on the left side of the recording medium P, the accelerated moving distance d4 between the head h4 and mark detector 160*a* is the same as the accelerated moving distance d4. As shown in FIG. 22(*b*), when the recording head H is stopped on the right side of the recording medium P, the accelerated moving distance d1' between the head 1 and mark detector 160 is the same as the accelerated moving distance d. In other words, d1'=d4 (=d), and d2'=d3, d3'=d2, d4'=d1, otherwise.

As described above, when mark detectors 160*a* and 160*b* are mounted on both ends of the recording head H in the main scanning direction, mark M can be detected on either the forward path or return path of the recording head H in the main scanning direction. So when the recording medium P must be moved accurately in the sub-scanning direction, every time the scanning of the recording head H in the main scanning direction (on either the forward or return path) is carried out, there is waste of time in cartridge operation even if the mark M is detected on either the forward or return path. Immediately after the mark detector 160 has detected the mark M, the cartridge can start the next image recording operation.

Figure 23:
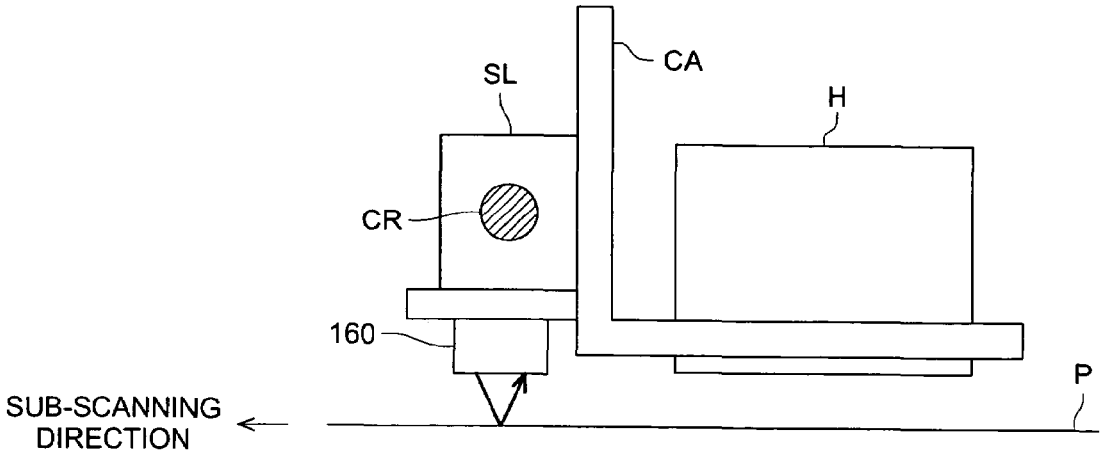
FIG. 23 is a schematic configuration diagram representing another layout of the optical sensor.

Such mark detectors 160 (160*a* and 160*b*) can be mounted on the carriage with the recording head H mounted thereon in such a way that detection light can be applied to the recording medium P. These detectors need not necessarily be mounted on the cartridge together with the recording head H. These detectors may be movable in the main scanning direction in conformity to the movement of the recording head H; therefore, they can be mounted on a support member such as a stay extended over the distance corresponding to the accelerated moving distance from the cartridge in the main scanning direction, for example. Alternatively, as shown in FIG. 23, the mark detectors 160 may be installed on the SL side of the stationary member (slide bearing) on the cartridge rail CR that guides the movement of the cartridge CA with the recording head H mounted thereon in the main scanning direction, so that the detection light can be applied to the recording medium P.

It is preferred that the mark detectors 160 (160*a* and 160*b*) be mounted so that the position of the recording head H in the main scanning direction will be adjustable. This arrangement permits adequate adjustment to be made even when the accelerated moving distance d varies according to the size of the recording medium P. In this case, use of visible light in the light emitting device 163 will provide easy alignment of the mark detectors 160 (160*a* and 160*b*) with the mark M position.

Figure 24:
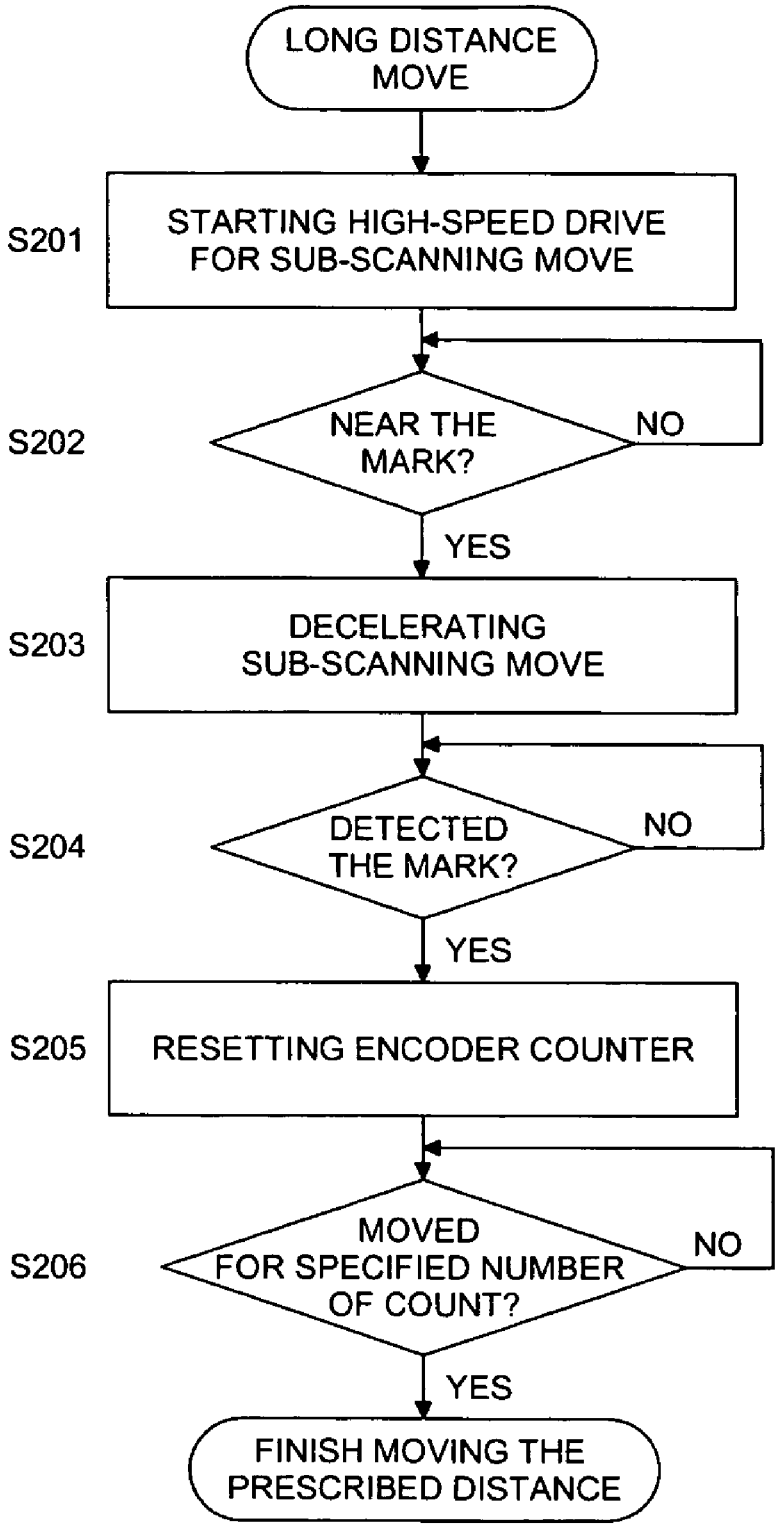
FIG. 24 is a flowchart showing the control operation when moving a recording medium.

FIG. 24 is a flowchart showing the control operation from the final n+3 scanning in the process of one-block printing by the head h, for example, to the first (n+4)-th scanning in the next block printing process, in the long-distance movement of the recording medium. Referring to the this flowchart and FIGS. 17 and 7, the following describes the control operations.

Upon termination of the one-block printing by four passes, the controller 10 controls the drive of the motor driver 114 so that the sub-scanning motor 115 is driven. The recording medium P is moved in the sub-scanning direction so that the position with the mark M recorded thereon will come close to the mark detector 160 mounted on the recording head H (S201). The recording head H in this case is stopped at the reversing position in the reciprocating motion. The mark detector 160 is located so as to detect the mark M.

As shown in FIG. 17, in the present embodiment, rollers R1 and R2 are provided with an encoder 117 as moving distance detecting means for detecting the moving distance of the recording medium P. If the mark M can be recorded from a specific nozzle at specifically time intervals, the approximate position is known in advance. Accordingly, by counting the pulses of the encoder 117 when the recording medium P is moved, it is possible to determine if the mark M has come close to where it is detected by the mark detector 160.

By counting the encoder 117, the controller 10 detects that the mark M has moved close to where it is detected by the mark detector 160 (S202). To ensure an accurate detection of the mark M by the mark detector 160, the drive speed of the sub-scanning motor 115 is switched to a low speed so that the recording medium P is moved at a low speed. (S203) In this manner, the recording medium P is moved at a high speed until it comes close to where it can be detected, and is then moved at a low speed after it has come close thereto. This arrangement ensures accurate detection of the mark M in a shorter time, with the result that the recording time is cut down—a preferred feature of the present embodiment.

When the recording medium P is moving, the recording head H is waiting at the position where the detection light emitted from the mark detector 160 passed over the mark M recorded on the recording medium P (non-printing area of the recording medium P). This mark M is then detected by the mark detector 160 and the detection signal is sent to the controller 10 (S204).

When this mark M has been detected, the controller 10 detects the mark M from the count of the encoder 117, and at the same time, resets the previous count of the encoder 117 (S205). This count is stored in the storage section 118 from the controller 10, as shown in FIG. 17.

In the controller 10, the position where the detection signal of the mark M has been detected is assumed as a reference position for long-distance movement of the recording medium P. In other words, the controller 10 further controls the drive of the motor driver 114 to drive the sub-scanning motor 115, so that the recording medium P is moved in the sub-scanning direction. The controller 10 newly starts counting of the pulses of the encoder 117 from the aforementioned detection position. The mark M is recorded at specifically timed intervals from a specific nozzle (from the nozzle No. m of the head to the first scanning of the first block in FIG. 7), and this arrangement shows what are appropriate counts, from this position where the mark M has been detected, that provide proper movement of the recording medium P to get to the appropriate position for starting the first scanning ((n+4)-th scanning in FIG. 7) for printing the next block.

The controller 10 stores the count (specified count) up to this appropriate position. By counting the pulses of the encoder 117, the controller 10 causes the recording medium P to be moved from the mark M-detected position (S206). Once adjusted, the distance from the mark detector 160 to the position where the mark M recorded on the recording medium P has been detected is fixed by the mark detector 160 and the mark M-recorded position, and is therefore kept constant, independently of environmental conditions or mechanical errors of the feed rollers R1 and R2. Thus, even when the recording medium P has been moved in the sub-scanning direction over a long distance close to the head length, a movement error is very small, with the result that drastic reduction of the feed error is achieved for long-distance movement. Even when printing of the next block is started by the recording head H, this arrangement allows printing, without white stripe being produced between this block and the previously printed block.

It may occur that correct detection of the mark M by the mark detector 160 cannot be achieved in the aforementioned step S204 because the mark M is not recorded on the recording medium P for some reason or the mark M has been erased, although the recording medium P has been moved to the position where the mark M is to be detected. In this case, the controller 10 moves the recording medium P according to the previous moving distance. To put it another way, as described above, the storage section 118 stores the count of the encoder 117 up to the time of detecting the previous mark M. The moving distance of the previous recording medium P in the long-distance movement can be estimated from the count stored therein and the aforementioned specified count. Thus, even if the mark M cannot be detected correctly, the controller 10 controls the drive of the motor driver 114 and sub-scanning motor 115, based on the previous moving distance, with the result that the recording medium P can be moved without any crucial error.

The moving distance of the recording medium P in the sub-scanning direction until the mark detector 160 detects the mark M recorded on the recording medium P is preferred to be smaller than the distance that should be covered by the movement in the sub-scanning direction, namely, the distance in the long-distance movement carried out for next block printing in the case of the aforementioned block printing. This arrangement causes the mark M to be detected in one direction along the direction of sub-scanning when the mark M is detected by the mark detector 160, thereby contributing to improved detection accuracy.

In the aforementioned description, when the recording medium P is moved over a long distance in the sub-scanning direction, the mark M recorded on the recording medium P is detected by the mark detector 160. The detection position of the detection signal is used as a reference to determine the distance covered by the movement of the recording medium P by the recording medium moving section. It is also possible to make such arrangements that this methods can be switched over to the method wherein the distance of movement of the recording medium P by the recording medium moving section is determined, only by counting the pulses from the encoder 117 shown in FIG. 17, in the movement of the recording medium P in the sub-scanning direction.

In this case, the controller 10 is provided with a switching device for selecting between the aforementioned two methods, as a way of determining the moving distance of the recording medium P by the recording medium moving section. For example, when the streak and stripe are to be minimized by recording of high image quality, the moving distance is determined with reference to the position of the detection signal for detecting the mark M recorded on the recording medium P. When preference is to be given to printing time over image quality by the high-speed recording, the moving distance can be determined only according to the count of the pulses of the encoder 117. If this arrangement is adopted, accurate movement of the recording medium P is ensured in the former case, and speed improvement is provided through cutting down time in the movement of the recording medium P in the latter case.

For the mark M recorded on the recording medium P, it is also preferred to arrange such a configuration that a plurality of marks are recorded on the recording medium P at a time by the ink particles discharged from a plurality of heads on one head. The nozzle of the recording head is normally set to have a constant pitch in the design phase, based on the assumption that the ink particles are emitted straight from each nozzle. In the recording head manufactured in the normal production process, there may occur a deviation in the position of ink particles hitting the recording medium, due to the variations in the shape, ink discharge speed and ink discharge angle among a plurality of nozzles. The mark M is recorded by the ink particles discharged from nozzles having deviations in the position of ink particles hitting the recording medium P. If the recording medium is moved over a long distance with reference to this detected position, an error may occur. When a plurality of marks M are recorded on the recording medium P at a time from a plurality of different nozzles on one head, it is possible to minimize occurrence of errors resulting of deviations occurring to each nozzle, thereby contributing to further improvement in the feed accuracy.

Figure 25:
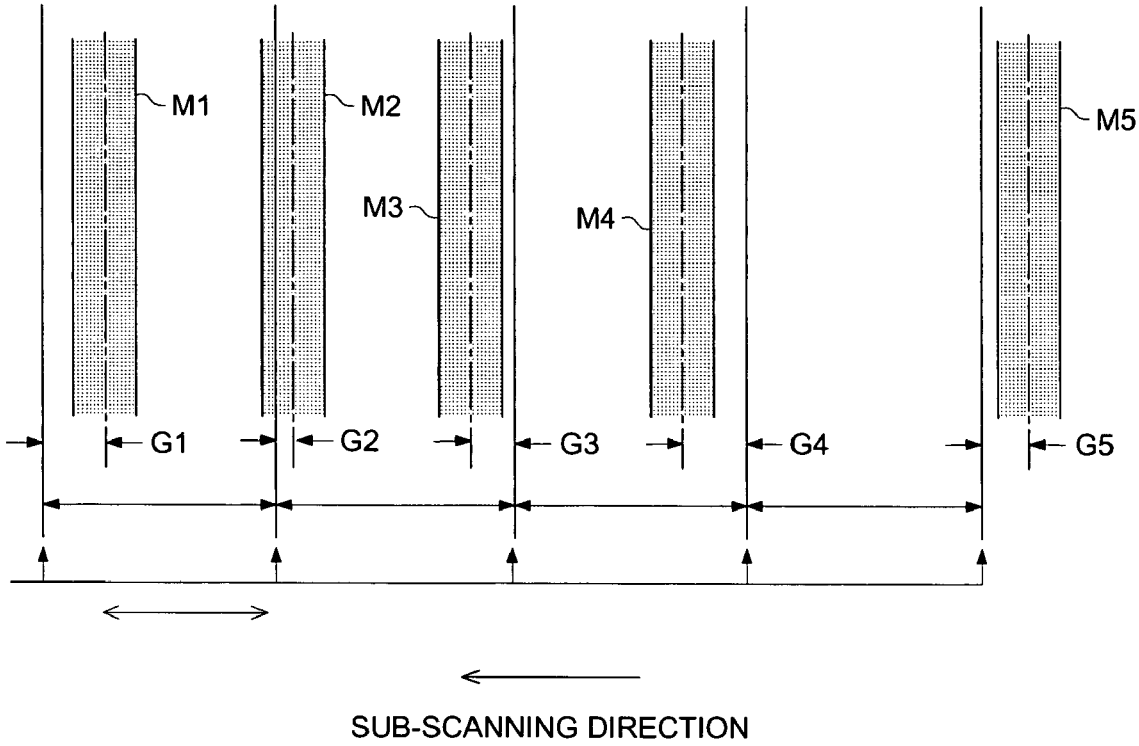
FIG. 25 is an explanatory diagram representing the operation when recording a plurality of marks.

Referring to FIG. 25, the following describes this embodiment. FIG. 25 shows the case wherein ink particles are discharged at a time from five adjacent nozzles of one head, whereby five linear marks M1 through M5 are recorded. The linear marks M1 through M5 recorded by this arrangement is originally intended to serve as design values for the pitches of the five adjacent nozzles. In FIG. 25, a solid line indicates the assumed position where the five regular marks calculated from the design values of the nozzle pitches are to be recorded. In the assumed position, the nozzle pitches are arranged at an equally spaced interval. However, actual marks M1 through M5 have different spaces, as shown in the figure, due to deviations in the position of ink particles hitting the recording medium P for each nozzle. The aforementioned assumed position shown by the solid line is concerned with processing performed in the controller 10 shown in FIG. 17; it is not displayed actually on the recording medium P.

As shown in FIG. 17, marks M1 through M5 recorded on the recording medium P are detected sequentially by the mark detector 160 installed on the recording head H according to the movement of the recording medium P in the sub-scanning direction. In FIG. 25, the one-dot chain line indicates the detected position where marks M1 through M5 detected by the mark detector 160.

The controller 10 shown in FIG. 17 detects the errors G1 through G5 between the aforementioned assumed position and detection position. These errors G1 through G5 are detected as positive or negative error, depending on the position in the sub-scanning direction in the aforementioned assumed position. For example, in FIG. 25, it can be seen that errors G1, G2 and G5 has positive errors while the errors G3 and G4 have negative errors.

Then the controller 10 calculates the sums of the aforementioned errors G1 through G5, and estimates the aforementioned assumed position where this value is the minimum. This procedure finds out the position where the detection error of the aforementioned detection position from the assumed position as a space calculated from the nozzle pitch is the minimum. The controller 10 determines the moving distance of the recording medium P with reference to the assumed position calculated and estimated in the aforementioned manner. Then the controller 10 controls the drive of the motor driver 114 so that the sub-scanning motor 115 and hence the recording medium P are driven. This arrangement minimizes the error of the mark M detected positions caused by variations for each nozzle of the recording head, and ensures highly accurate movement of the recording medium P.

In the mark detector 160 consisting of a reflection sensor, the detection light emitted from the light emitting device 163 obliquely enters the surface of the recording medium P through the condensing lens 164, as shown in FIG. 18, and the reflected light there is received by the light receiving device 166 through the condensing lens 165. The optical axis L1 emitted from the light emitting device 163 to the recording medium P is opposite to the optical axis L2 of the detection light reflected from the recording medium P to the light receiving device 166, at an angle of θ. In this case, when ink is placed on the recording medium P, wrinkles may be produced, air may enter the space between the recording medium P, the platen arranged on the back thereof, and recording medium P is heaved toward the side of the recording head H. If such troubles have caused the surface of the recording medium P to become corrugated, then the deflection light reflected from the surface of the recording medium P cannot be received correctly by the light receiving device 166, with the result that a detection error may be produced.

The following describes a more preferable mark detector 160 that provides accurate detection of the mark M even when variations have occurred in the height of the surface of the recording medium P due to such factors.

Such a mark detector 160 is arranged in such a way that the optical axes L1 and L2 will be approximately vertical to the surface of the recording medium P. Since the optical axes L1 and L2 are approximately vertical to the surface of the recording medium P, there is not a big fluctuation in the position for receiving the detection light in the sub-scanning direction or a serious influence upon detection accuracy, even when variations have occurred in the height of the surface of the recording medium P. Thus, this arrangement provides accurate detection of the mark M.

The expression "approximately vertical" refers to the state where the angle θ formed by the optical axis L1 of the detection light emitted to the surface of the recording medium P from the light emitting device and the optical axis L2 of the detection light reflected from the surface of the recording medium P toward the light emitting device is within the range of ±10° C.

Figure 26:
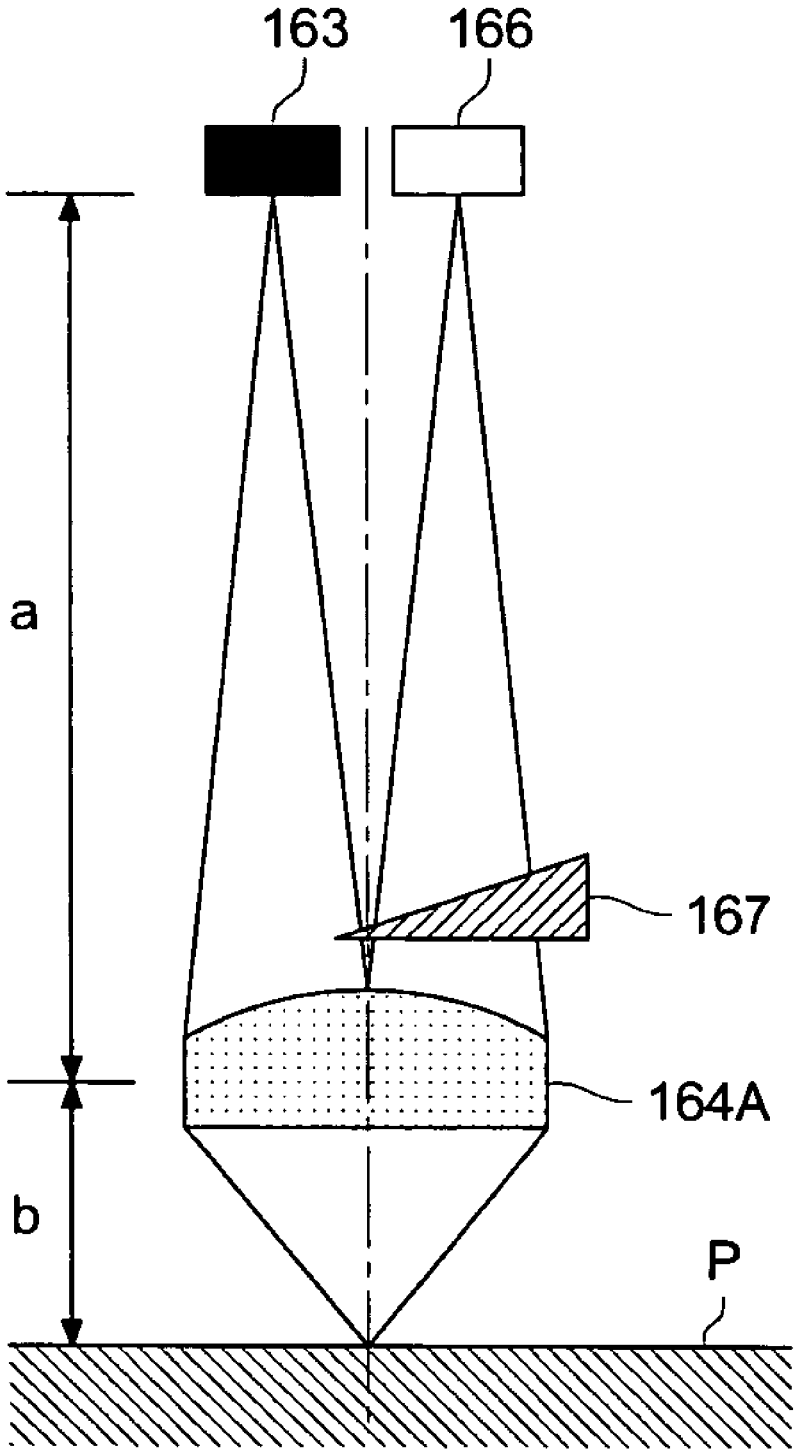
FIG. 26 is a drawing representing another configuration of the optical sensor.
Figure 27:
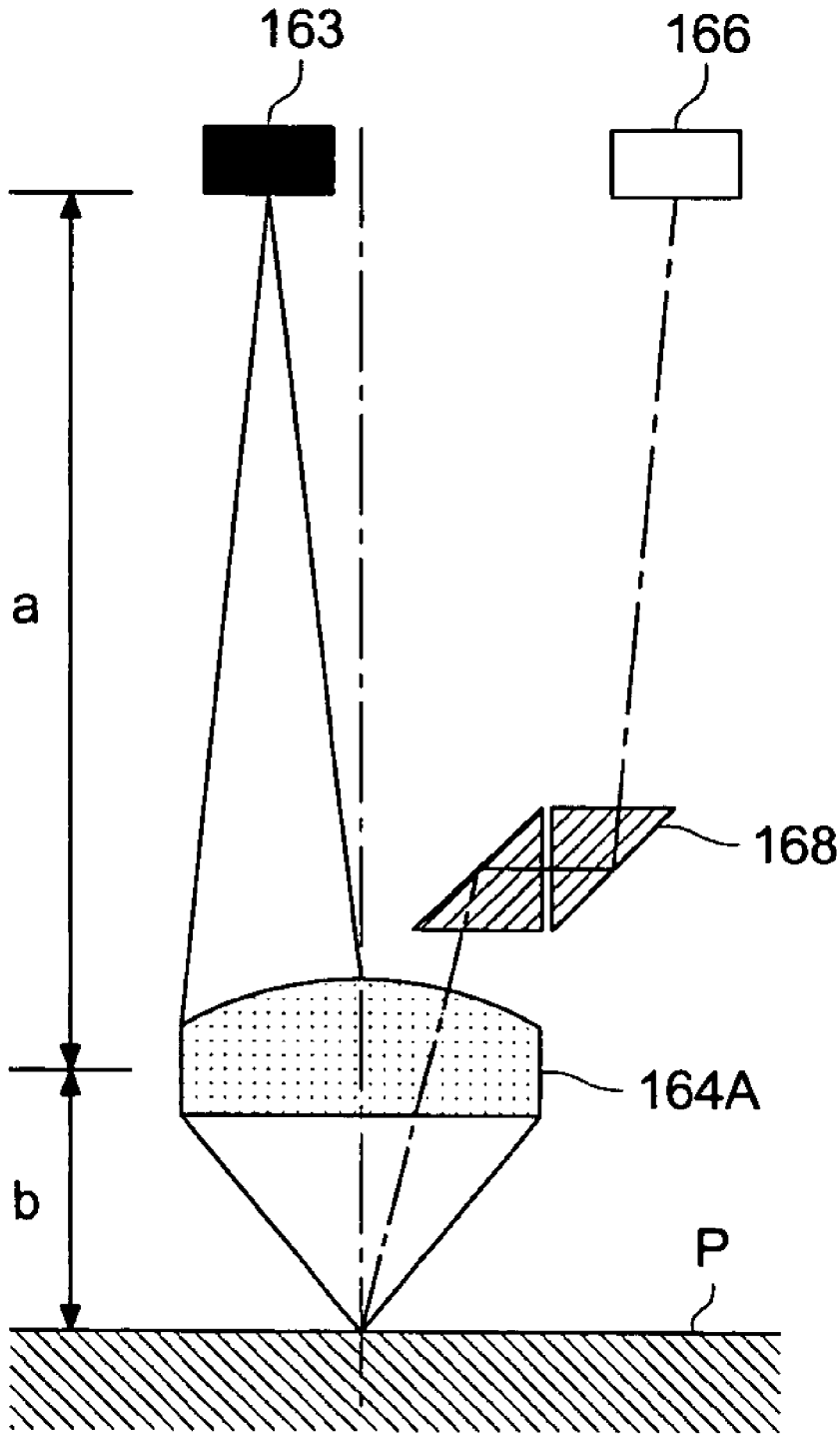
FIG. 27 is a drawing representing still another configuration of the optical sensor.

Referring to the FIGS. 26 through 28, the following describes the configuration of the aforementioned mark detector 160.

In FIG. 26, the mark detector 160 and light receiving device 166 are placed close to each other and are parallel to the surface of the recording medium P. The detection light emitted from the light emitting device 163 is applied approximately vertical to the surface of the recording medium P through the 164A. A wedge lens 167 is arranged on the side just short of the condensing lens 164A (where the light emitting device 163 and light receiving device 166 are installed), and the detection light applied to the surface of the recording medium P from the light emitting device 163 through the condensing lens 164A is partly regulated. Because of this arrangement, after passing through the condensing lens 164A in the similar manner, the light reflected approximately vertical to the surface of the recording medium P passes through the wedge lens 167 and enters the light receiving device 166 arranged in parallel to the light emitting device 163.

FIG. 27 shows the case where a prism 168 is used instead of the wedge lens 167 in the FIG. 26. In this case, the detection light emitted approximately vertical to the surface of the recording medium P from the light emitting device 163 through the condensing lens 164A is partly regulated by the prism 168. The light reflected in the approximately vertical to the surface of the recording medium P passes through the condensing lens 164A in the similar manner. Then it passes through the prism 168 and enters the light receiving device 166 arranged in parallel to the light emitting device 163.

In this embodiment, the light receiving device 166 and light emitting device 163 are installed in parallel. This arrangement provides the advantages of freely setting the outlet of the reflected light, depending on the configuration of the prism 168, whereby freedom in the layout of the light receiving device 166 is improved.

In FIG. 28(*a*), a common condensing lens 164B is used for the light emitting device 163 and light receiving device 166. As shown in FIG. 28(*b*), this condensing lens 164B is divided into two areas; an area 164$B_1$ where the light coming from the light emitting device 163 is condensed and converged on the surface of the recording medium P, and an area 164$B_2$ where the light reflected from the recording medium P is condensed and converged on the light receiving device 166.

Accordingly, the detection light emitted from the light emitting device 163 is condensed and converted approximately vertical to the surface of the recording medium P by the area 164$B_1$, and is applied thereto. The light reflected from the surface of the recording medium P in the approximately vertical direction is condensed and converged to the light receiving device 166 installed parallel to the light emitting device 163, by the area 164$B_2$ of the condensing lens 164B.

According to this arrangement, use of only one condensing lens 164B permits such a configuration that the optical axis of the detection light applied to the recording medium P from the light emitting device 163 is approximately vertical to the recording medium, with the result that the configuration of the mark detector 160 is simplified.

As described above, when the mark detector 160 where optical axes L1 and L2 are arranged to be approximately vertical to the surface of the recording medium P is used as a mark detecting means, ink particles are discharged from a plurality of different nozzles. If a plurality of marks M are to be recorded at a time, the light emitting device 163, condensing lens 164A and 164B, and recording medium P are preferred to meet the conditions of $k \times b < a \times m$, where "k" denotes the chip size of the light emitting device 163 in the sub-scanning direction; "a" the distance among the light emitting devices 163A and 163B; "b" the distance between condensing lenses 164A and 164B and light emitting device 163; and "m" the pitch width of the mark M in the sub-scanning direction (see FIGS. 26 through 28).

When the above conditions are met, the spot diameter of the detection light is smaller than the pitch width of the mark M in the sub-scanning direction, and the signal level of the detection light among a plurality of marks M to be detected can be reduced sufficiently. Thus, the detecting portion of the mark M can be clearly differentiated from the non-detecting portion among marks M, thereby ensuring accurate detection of a plurality of marks M.

Embodiment-4

Figure 29:
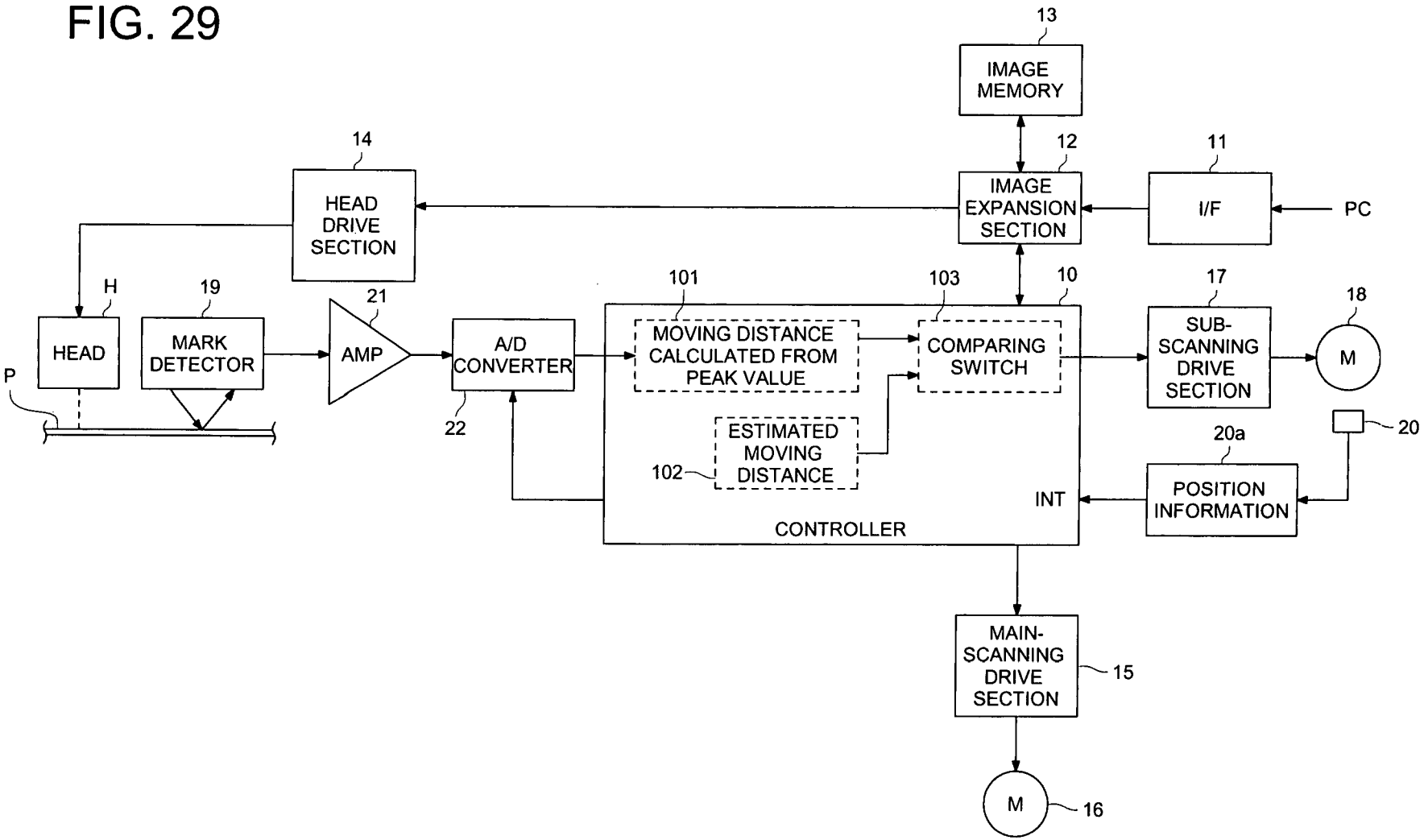
FIG. 29 is a configuration block diagram of an ink-jet recording apparatus of the present invention.

As shown in FIG. 29, the controller 10 is provided with operation part 101. When the center position of the mark M has been detected, this operation part 101 calculates the target moving distance (moving distance calculated from peak value) from when the movement of the recording medium P is started until when movement to the appropriate position has completed finally.

When the first movement of the recording medium P is started, the mark M is located short of the position of the recording medium P as a final target. The approximate position where the mark M is detected is known in advance when the movement of the recording medium P is started. Accordingly, the moving distance (L yobun) of $+\alpha$ is added to the moving distance (L mark-true) from the position of starting the mark M movement to the position where the mark M is actually detected, wherein the moving distance (L yobun) of $+\alpha$ refers to the moving distance from the position where the mark M is detected, to the appropriate position for next printing. After that, the movement of the recording medium P is stopped. This moving distance (L yobun) of $+\alpha$ indicates the moving distance in terms of the count of the encoder pulses in order to get to the appropriate position for the next printing, wherein counting is started from the position shown by the information on the position where the mark M has been detected. This value is known in advance since the mark M is recorded from a specific nozzle at specifically timed intervals.

To put it another way, the moving distance calculated from peak value is the moving distance (L mark−true+L yobun) obtained by adding:

the moving distance (L mark−true) from the start of movement of the recording medium P to the position where the mark M has been detected, as described above, and the moving distance (L yobun) from the actual position of the mark M to the appropriate position for next printing. The count corresponding to this moving distance (L yobun) is stored in the predetermined area of the controller 10 in advance.

As shown in FIG. 29, the controller 10 is provided with a storage section 102, which stores the estimated moving distance (L yosoku) as a target moving distance that is estimated to be covered from the start of the movement of the mark M, to the movement of the recording medium P almost appropriately to the target position. This estimated moving distance (L yosoku) approximately matches the moving distance calculated from peak value (L mark−true+L yobun) as the target moving distance calculated by the operation part 101.

It is preferred that the estimated moving distance (L yosoku) stored in the storage section 102 be provided for each type of the recording medium being used. The type of the recording medium includes the type of thickness of the recording medium, in addition to paper, plastic sheet and laminated sheet of paper whose side or sides are coated with plastic. The paper can be divided into many types such as plain paper, coated paper and cast paper.

It is also preferred that the estimated moving distance (L yosoku) stored in the controller 10 be provided for each recording mode. The recording mode in terms of resolution includes a low resolution mode recording at 360 pdi and a high resolution mode recording at 760 pdi.

By storing the estimated moving distance (L yosoku) for each type of the recording medium or for each type of the recording mode, highly accurate movement over the optimum moving distance in response to each type of the recording medium or for each type of the recording mode can be provided, even when the recording medium P is moved according to estimated moving distance (L yosoku). The type of the recording medium or for each type of the recording mode to be used can be selected by a user through setting operations.

This storage section 102 consists of a rewritable memory that allows the aforementioned estimated moving distance (L yosoku) to be rewritten.

Further, as shown in FIG. 29, the controller 10 is provided with a comparing switch 103 that compares the moving distance calculated from peak value (L mark−true+L yobun) worked out the aforementioned operation part 101 and the estimated moving distance (L yosoku) stored in the storage section 102 in advance. Based on the results of this comparison, the drive signal outputted to the sub-scanning driven section 17 for moving the recording medium P is switched over to either the drive signal conforming to the aforementioned moving distance calculated from peak value peak value calculated moving distance or the drive signal conforming to the aforementioned estimated moving distance, on a selective basis. This comparing switch 103 is equivalent to the comparing section and switching section.

Figure 30:
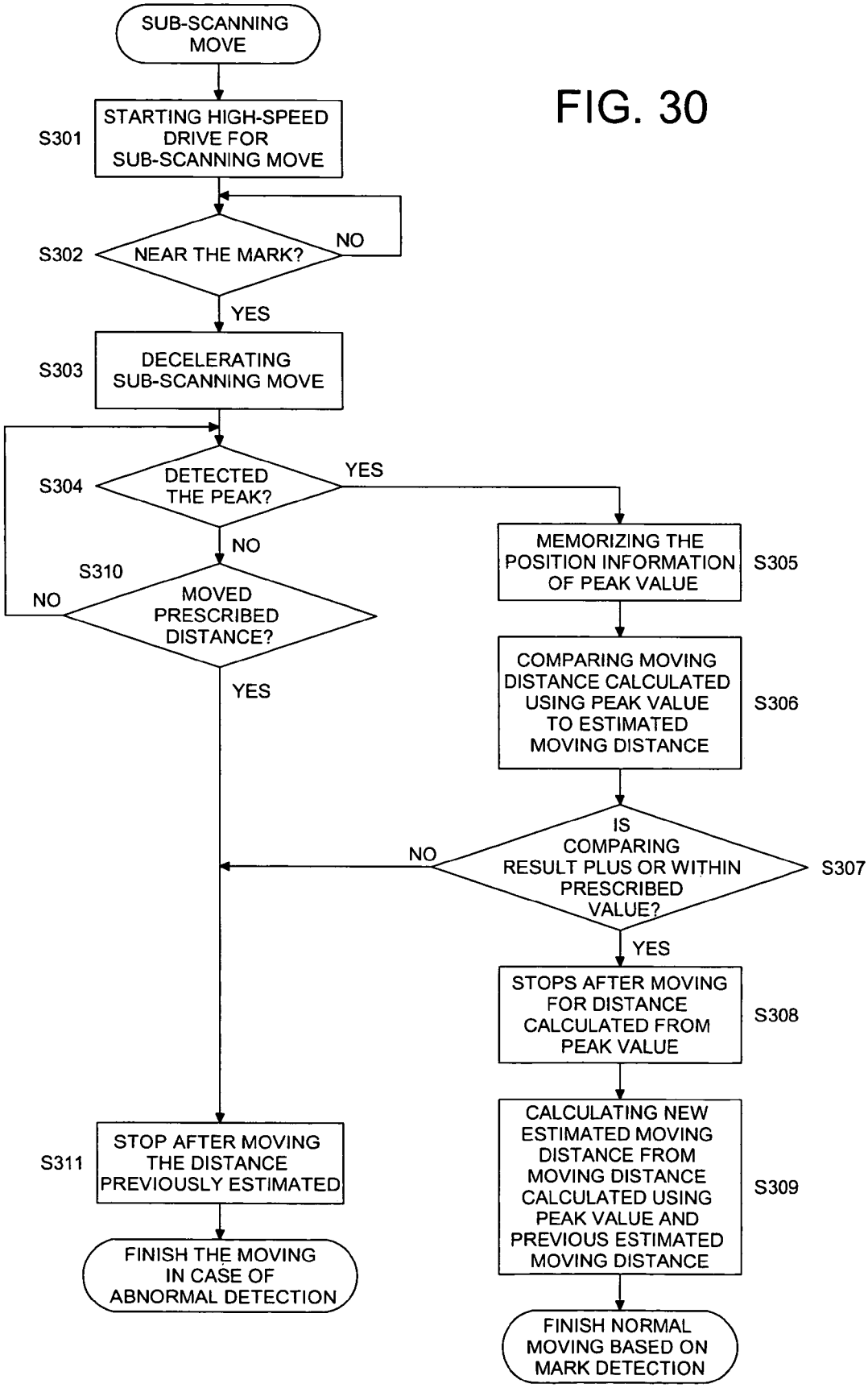
FIG. 30 is a flowchart showing the control operation during the movement of a recording medium.

FIG. 30 shows the control operation ranging from the last n+3rd scanning to the first (n+4)-th scanning in the printing of next block, for example, during the one-block printing by the head h shown in FIG. 7, in the process of the long-distance movement of the recording medium. Referring to this flowchart and FIGS. 29 and 7, the following describes the control operation.

Upon termination of the one-block printing by four passes, the controller 10 controls of the drive of the sub-scanning driven section 17 to drive the sub-scanning motor 18 at a high speed. It moves the recording medium P at a high speed in the sub-scanning direction in such a manner that the position where the mark M is recorded will come close to the mark detector 19 provided near the recording head H (S301).

The pulses of the rotary encoder in the movement of the recording medium P is counted by the encoder sensor 20, thereby detecting if the mark M has come to the position where the mark M is detected by the mark detector 19. Upon detecting that the mark M has come to the position where the mark M is detected by the mark detector 19, by counting the pulses of the rotary encoder in the aforementioned manner (S302), the controller 10 switches the drive speed of the sub-scanning motor 18 over to the low speed, to ensure accurate detection of the mark M by the mark detector 19, thereby allowing the recording medium P to be driven at a lower speed (S303). In this manner, the recording medium P is moved at a high speed until it comes close to where it can be detected, and is then moved at a low speed after it has come close thereto. This arrangement ensures accurate detection of the mark M in a shorter time, with the result that the recording time is cut down—a preferred feature of the present embodiment.

When the recording medium P is moving, the recording head H is waiting at the position where the detection light emitted from the mark detector 19 passed over the mark M recorded on the recording medium P (non-printing area of the recording medium P). The analog detection signal detected by the mark detector 19 is amplified by the AMP 21, and is then fed to the A/D converter 22, where it is converted into the digital signal. The controller 10 allows the A/D converter 22 to convert the analog output signal from the mark detector 19 into the digital signal, immediately before the position where the mark M is estimated to be detected, at timed intervals when the position information 20*a* is outputted. It allows inputting of the position information 20*a* from the encoder sensor 20 corresponding to the sampling data of each output value. This position information 20*a* and the output value subjected to A/D conversion by the A/D converter are stored in a predetermined storage area of the controller 10.

When the recording medium P has moved predetermined distance in the sub-scanning direction, the mark detector 19 passes through the mark M. In this case, the controller 10 detects the position information corresponding to the peak sampling value from the sampling data of the position information 20*a* (S304).

When the position information of the peak value has been detected (Yes in step S304), the position information of the peak value is stored in a predetermined storage area of the controller 10 (S305).

Since the position information of the peak value detected in the aforementioned manner indicates the center position of the mark M, the controller 10 at this time allows the operation part 101 to work out the moving distance calculated from peak value (L mark−true+L yobun), with reference to this position information for the long-distance movement of the recording medium P, wherein the aforementioned moving distance calculated from peak value (L mark−true+L yobun) is obtained by adding the moving distance (L mark-true) from start of the long-distance movement of the recording medium P to the this reference position, to the appropriate position for next printing for carrying out the first scanning ((n+4)-th scanning in FIG. 7) to print the next block.

Then the controller 10 uses the comparing switch 103 to compare the moving distance calculated from peak value (L mark−true+L yobun) worked out in the operation part 101 and the estimated moving distance (L yosoku) stored in the storage section 102 in advance (S306). Since the appropriate position for the first scanning ((n+4)-th scanning in FIG. 7) for printing the next block as the final target position is not yet reached at this time, the controller 10 allows the comparing switch 103 to select whether the final target moving distance for moving the recording medium P from here should be the moving distance calculated from peak value (L mark−true+L yobun) or the estimated moving distance (L yosoku).

For comparison of the moving distance by the comparing switch 103, the difference (X=moving distance calculated from peak value−estimated moving distance) between the moving distance calculated from peak value (L mark−true+L yobun) and the estimated moving distance (L yosoku) is calculated, and the result is compared with the set value Y set in advance.

Figure 31:
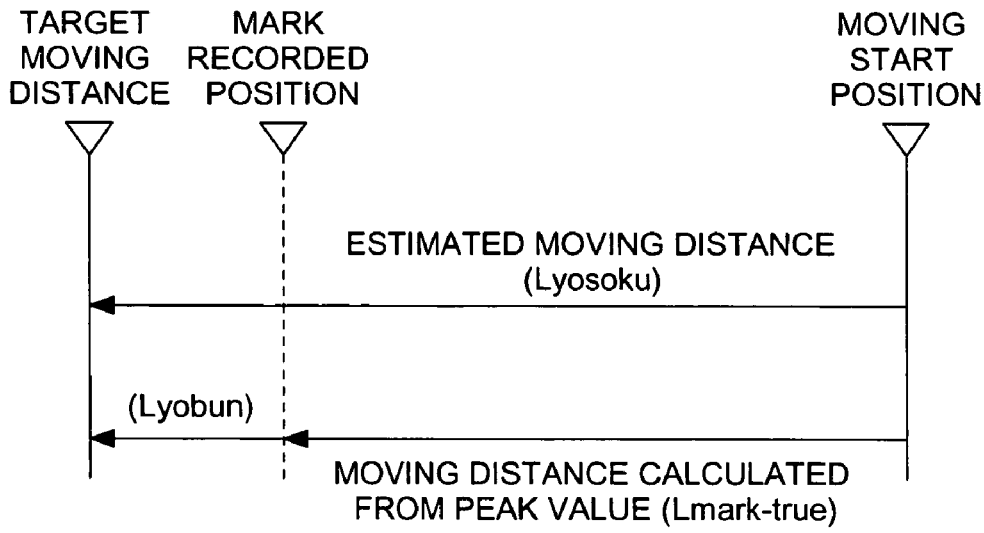
FIGS. 31(*a*) and (*b*) are drawings for comparing the moving distance calculated from peak value and estimated moving distance.
Figure 31:
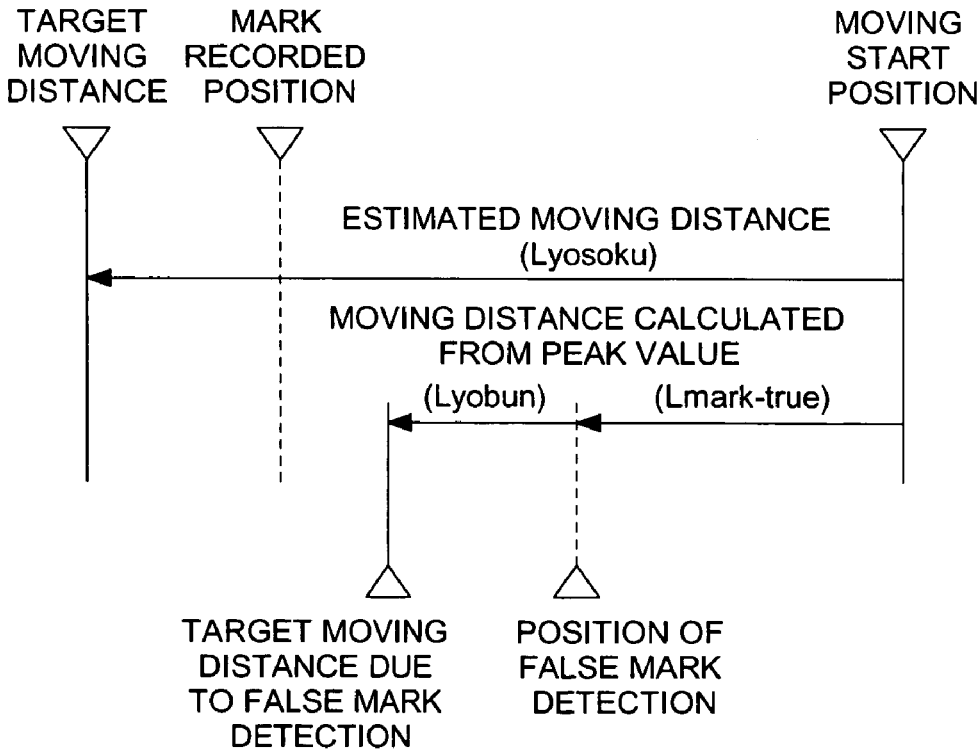

For example, as shown in FIG. 31(*a*), if the difference X between the moving distance calculated from peak value (L mark−true+L yobun) and the estimated moving distance (L yosoku) is 0 or a very small value, it can be determined that the mark M on the recording medium P has been detected approximately correctly by the mark detector 19. As shown in FIG. 9(*b*), when a contamination, for example, is attached considerably short of the position where mark M is recorded on the recording medium P, and is mis-read as a mark by the mark detector 19, the moving distance calculated from peak value (L mark−true+L yobun) becomes smaller than the estimated moving distance (L yosoku). The difference X will be negative. In this case, the aforementioned set value Y should be set at a certain negative value in such a way that, if a value smaller than this set value Y has been detected, it will be assumed as a mark error detection.

This set value Y is determined as appropriate in conformity to the target moving distance of the recording medium P. For example, it can be set at a value smaller about 0.5% than the target moving distance.

If a slip has occurred to the recording medium P before the mark M is detected by the mark detector 19, the actual moving distance of the recording medium P becomes smaller than the count of pulses of the encoder, and the number of pulses of the encoder before the mark M is detected is increased. Thus, the moving distance calculated from peak value (L mark−true+L yobun) becomes greater than the estimated moving distance (L yosoku) and the difference X becomes a positive value. Since detection is made after subsequently passing through the mark M, the required movement should be over the remaining moving distance (L yosoku) from the position where the mark M has been detected. Accordingly, when the difference X has exceeded 0 and becomes positive, the overall moving distance of the recording medium P should be based on the moving distance calculated from peak value (L mark−true+L yobun). Thus, for the aforementioned set value, a certain negative value Y is used as a reference value. This set value Y is stored in the predetermined area of the controller 10 in advance.

When the comparing switch 103 compares the aforementioned distance X with this set value Y, and $X \geqq Y$ (or $X>Y$) has been obtained, then the controller 10 assumes that the mark M on the recording medium P has been almost appropriately detected by the mark detector 19. Further, the $X<Y$ (or $X \leqq Y$) will be assumed as a mark detection error. If the recording medium P is moved according to the moving distance calculated from peak value (L mark−true+L yobun), the recording medium P cannot be fed to an accurate position for next block printing, as will be clear from FIG. 31(*b*). Thus, the controller 10 determines that the overall moving distance of the recording medium P should be moved in conformity to the estimated moving distance (L yosoku).

Based on the comparison between the moving distance calculated from peak value (L mark−true+L yobun) and the estimated moving distance (L yosoku), the controller 10 determines if the difference X meets the condition of X≧Y (or X>Y) with respect to the set value Y (S307). If this condition is met (YES in the aforementioned step S7), the controller 10 assumes that the mark M has been correctly detected by the mark detector 19. The comparing switch 103 performs a switching operation so that the drive signal for driving the sub-scanning driven section 17 will be outputted in conformity to the moving distance calculated from peak value (L mark−true+L yobun). Thus, the recording medium P is moved the distance equivalent to the moving distance calculated from peak value (L mark−true+L yobun) and is then stopped (S308). This arrangement moves the recording medium to the appropriate position for the first scanning ((n+4)-th scanning in FIG. 7) for printing the next block by the head h.

Once adjusted, the distance from the mark detector 19 to the position where the mark M recorded on the recording medium P has been detected is fixed by the mark detector 19 and mark M recorded position; therefore, it is constant independently of the environment or the mechanical errors in the rollers R1 and R2. Even when the recording medium P is moved a long distance close to the head length in the sub-scanning direction, only a small traveling error occurs, with the result that drastic reduction of the feed error is achieved for long-distance movement. Even when printing of the next block is started by the recording head H, this arrangement allows printing, without white stripe being produced between this block and the previously printed block.

If the moving distance calculated from peak value (L mark−true+L yobun) has been selected as a result of comparison between the moving distance calculated from peak value (L mark−true+L yobun) and the estimated moving distance (L yosoku) by the comparing switch 103, the controller 10 adds the moving distance calculated from peak value (L mark−true+L yobun) to the estimated moving distance (L yosoku) stored in advance, and gets the average value (S309). The controller 10 assumes that a new estimated moving distance (L yosoku) calculated here is the estimated moving distance to be used in the next comparison, and replaces the old estimated moving distance stored in the storage section 102 with this new one for updating.

The step S309 allows the estimated moving distance (L yosoku) to be adjusted to an infinitely accurate moving distance. Even if the comparing switch 103 has selected the estimated moving distance (L yosoku), to be described later, and the recording medium P has to be moved in conformity to this estimated moving distance (L yosoku), this arrangement permits the recording medium P to be moved a moving distance close to infinitely appropriate moving distance. Even if an unforeseen accident such as the detection error of the mark M has occurred, printing can be continued without serious deterioration of the image quality.

The moving distance calculated from peak value (L mark−true+L yobun) used to update the estimated moving distance (L yosoku) stored in the storage section 102 is preferred to be restricted to the one having an error not exceeding a predetermined level with respect to the estimated moving distance (L yosoku). To put it another way, only when the moving distance calculated from peak value (L mark−true+L yobun) is within the aforementioned range relative to the estimated moving distance (L yosoku) stored in advance, the estimated moving distance (L yosoku) can be updated. This estimated moving distance (L yosoku) should be the average value of the moving distance for the actual movement of the recording medium P. Thus, an infinitely close agreement with the moving distance calculated from peak value (L mark−true+L yobun) can be obtained by such updating. An infinitely accurate movement can be achieved even when the recording medium P is moved in conformity to the estimated moving distance (L yosoku). This predetermined value can be determined as appropriate in response to the target measured value. For example, it can be set at about ±0.2% through 0.3% relative to the estimated moving distance.

The correct movement operation by detection of the mark M terminates after updating the estimated moving distance (L yosoku) in the aforementioned manner.

In the aforementioned step S307, if comparison is made between the moving distance calculated from peak value (L mark−true+L yobun) and the estimated moving distance (L yosoku), and the difference X is negative wherein this negative difference is a big difference below the set value Y (NO in step S307), then the controller 10 assumes that a mark M detection error has occurred, and allows the comparing switch 103 to switch the drive signal for driving the sub-scanning driven section 17 so that output will be conducted based on the estimated moving distance (L yosoku), and the sub-scanning motor 18 is driven to move the recording medium P a distance corresponding to the estimated moving distance (L yosoku) and to stop it thereafter (S311). This arrangement permits the recording medium P to be moved, according to the estimated moving distance (L yosoku), to the position assumed to be appropriate for the first scanning ((n+4)-th scanning in FIG. 7) in printing the next block by the head h.

Thus, even when a mark detection error has been caused by the mark detector 19 for some reason, the recording medium can be moved to the position assumed to be appropriate, according to the estimated moving distance (L yosoku) stored in advance. Thus, even if a measurement error in mark detection has occurred, the recording medium can be moved to the position assumed to be appropriate, according to the estimated moving distance, with the result that deterioration of the image quality is minimized and high quality image printing is provided.

In the aforementioned step S3, after the movement of the recording medium P has been started at a low speed, it is moved a distance estimated to be sufficient to pass through the mark M (S310). If the peak position by detection of the mark M cannot be detected thereafter (YES in the step S310), the controller 10 allows the comparing switch 103 to be switched so that the drive signal for driving the sub-scanning driven section 17 is outputted according to the estimated moving distance (L yosoku), and the sub-scanning motor 18 is driven to move the recording medium P a distance corresponding to the estimated moving distance (L yosoku) and to stop it thereafter (S311). Even if correct detection of the mark M by the mark detector 19 cannot be achieved because the mark M is not recorded on the recording medium P for some reason or the mark M has been erased, this arrangement permits the recording medium P to be moved, according to the estimated moving distance (L yosoku), to the position estimated to be appropriate for the first scanning ((n+4)-th scanning in FIG. 7) in printing the next block by the head h.

Then the system terminates movement operation for a mark M detection error (including non-detection).

What is claimed is:

1. An inkjet recording apparatus comprising:

a recording head which discharges ink toward a recording medium;

a recording medium moving section which moves the recording medium in a sub-scanning direction;

a position information detecting section which detects position information from the recording medium moving section, in synchronization with a movement of the recording medium moving section;

a mark recording section which records a predetermined mark on the recording medium;

a mark detecting section, which is arranged at a predetermined distance from the mark recording section in the sub-scanning direction, and which detects the mark recorded by the mark recording section while the recording medium is moved; and a control section which obtains a reference detection position of the mark corresponding to an actual moving distance of the recording medium, which is equivalent to the predetermined distance between the mark detecting section and the mark recording section, based on: (i) a signal outputted when the mark detecting section detects the mark and (ii) the position information detected by the position information detecting section, and which determines a residual moving distance of the recording medium, based on the reference detection position of the mark and a target moving distance of the recording medium, the residual moving distance being a difference between the target moving distance and the actual moving distance;

wherein the control section controls the recording medium moving section to move the recording medium by the residual moving distance from the reference detection position of the mark and then to stop moving the recording medium, such that the recording medium moving section stops moving the recording medium when the recording medium has been moved by the target moving distance;

wherein, based on the position information detected by the position information detecting section, the control section calculates an estimated timing at which the recording medium will be close to a position where the mark detecting section will detect the predetermined mark, wherein the control section starts receiving an output signal from the mark detecting section to obtain sampling data at the estimated timing, and wherein the control section calculates the reference detection position of the mark from the sampling data; and wherein the recording medium moving section moves the recording medium at high speed before the estimated timing and moves the recording medium at low speed after the estimated timing, and the mark detecting section detects the mark when the recording medium moving section moves the recording medium at low speed.

2. The inkjet recording apparatus of claim 1, wherein the control section calculates from the sampling data a position corresponding to a peak value of the output signal from the mark detecting section, and the control section calculates the reference detection position of the mark from the position corresponding to the peak value.

3. The inkjet recording apparatus of claim 1, further comprising:

an analog-to-digital conversion section for converting the output signal from the mark detecting section;

wherein the control section filters output values from the analog-to-digital conversion section.

4. The inkjet recording apparatus of claim 1, wherein the mark recording section simultaneously records a plurality of predetermined marks.

5. A recording medium movement control method comprising:

moving a recording medium by a recording medium moving section in a sub-scanning direction;

detecting position information from the recording medium moving section, in synchronization with a movement of the recording medium moving section;

recording a predetermined mark on the recording medium at a predetermined timing by a mark recording section;

detecting the mark, while the recording medium is moved, by a mark detecting section which is arranged at a predetermined distance from the mark recording section in the sub-scanning direction;

obtaining a reference detection position of the mark corresponding to an actual moving distance of the recording medium, which is equivalent to the predetermined distance between the mark detecting section and the mark recording section, based on: (i) sampling data of a signal outputted when the mark detecting section detects the mark, and (ii) the detected position information;

determining a residual moving distance of the recording medium, based on the reference detection position of the mark and a target moving distance of the recording medium, the residual moving distance being a difference between the target moving distance and the actual moving distance; and controlling the recording medium moving section to move the recording medium by the residual moving distance from the reference detection position of the mark and then to stop moving the recording medium, such that the recording medium moving section stops moving the recording medium when the recording medium has been moved by the target moving distance;

wherein the sampling data is obtained by obtaining an output signal from the mark detecting section just before an estimated timing at which the predetermined mark will be detected, and wherein the estimated timing is calculated based on the detected position information, and the reference detection position of the mark is calculated from the sampling data; and wherein the recording medium is moved by the recording medium moving section at high speed until just before the estimated timing and at low speed just before the estimated timing, and the mark is detected by the mark detecting section when the recording medium moving section moves the recording medium at low speed.

6. An inkjet recording apparatus, comprising:

a recording head which includes a plurality of nozzles arranged with a predetermined pitch along a sub-scanning direction, and which discharges ink toward a recording medium, to record an image by a block printing method in which the predetermined pitch is filled with at least one pass of the head, each pass of the head being accompanied by a short distance sub-scanning movement of the recording medium to complete a block of the image, and wherein after completion of the block the recording medium is moved by a long distance sub-scanning movement to be positioned for printing a next block of the image;

a recording medium moving section which moves the recording medium in the sub-scanning direction;

a position information detecting section which detects position information from the recording medium moving section, in synchronization with a movement of the recording medium moving section;

a mark recording section which records a predetermined mark on the recording medium for each said long distance sub-scanning movement;

a mark detecting section, which is arranged at a predetermined distance from the mark recording section in the sub-scanning direction, and which detects the mark recorded by the mark recording section while the recording medium is moved; and a control section which obtains a reference detection position of the mark corresponding to an actual moving distance of the recording medium, which is equivalent to the predetermined distance between the mark detecting section and the mark recording section, based on: (i) on a signal outputted when the mark detecting section detects the mark and (ii) the position information detected by the position information detecting section, and which determines a residual moving distance of the recording medium, based on the reference detection position of the mark and a target moving distance of the long distance sub-scanning movement of the recording medium, the residual moving distance being a difference between the target moving distance and the actual moving distance;

wherein the control section controls the recording medium moving section to move the recording medium by the residual moving distance from the reference detection position of the mark and then to stop moving the recording medium, such that the recording medium moving section stops moving the recording medium when the recording medium has been moved by the target moving distance of the long distance sub-scanning movement;

wherein, based on the position information detected by the position information detecting section, the control section calculates an estimated timing at which the recording medium will be close to a position where the mark detecting section will detect one said predetermined mark, wherein the control section starts receiving an output signal from the mark detecting section to obtain sampling data at the estimated timing, and wherein the control section calculates the reference detection position of the mark from the sampling data; and wherein the recording medium moving section moves the recording medium at high speed before the estimated timing and moves the recording medium at low speed after the estimated timing, and the mark detecting section detects the mark when the recording medium moving section moves the recording medium at low speed.

* * * * *